US007867080B2

(12) United States Patent
Nicely et al.

(10) Patent No.: US 7,867,080 B2
(45) Date of Patent: Jan. 11, 2011

(54) INTERACTIVE STREAK GAME

(75) Inventors: Mark C. Nicely, Daly City, CA (US); Doug Schwarz, San Francisco, CA (US)

(73) Assignee: IGT, Reno, NV (US)

( * ) Notice: Subject to any disclaimer, the term of this patent is extended or adjusted under 35 U.S.C. 154(b) by 889 days.

(21) Appl. No.: 10/668,670

(22) Filed: Sep. 22, 2003

(65) Prior Publication Data

US 2004/0116179 A1 Jun. 17, 2004

Related U.S. Application Data

(60) Provisional application No. 60/411,849, filed on Sep. 18, 2002.

(51) Int. Cl.
*A63F 9/24* (2006.01)

(52) U.S. Cl. ..... 463/25; 340/323 R

(58) Field of Classification Search ..... None
See application file for complete search history.

(56) References Cited

U.S. PATENT DOCUMENTS

| | | | |
|---|---|---|---|
| 3,684,290 | A | 8/1972 | Wayne |
| 3,852,576 | A | 12/1974 | Rudd |
| 3,918,716 | A | 11/1975 | Nonaka et al. |
| 4,095,795 | A | 6/1978 | Saxton et al. |
| 4,095,824 | A | 6/1978 | Bachman |
| 4,099,722 | A | 7/1978 | Rodesch et al. |
| 4,101,129 | A | 7/1978 | Cox |
| 4,238,127 | A | 12/1980 | Lucero et al. |
| 4,299,388 | A | 11/1981 | Resch et al. |
| 4,508,345 | A | 4/1985 | Okada |
| 4,624,459 | A | 11/1986 | Kaufman |
| 4,856,787 | A | 8/1989 | Itkis |
| 5,178,395 | A | 1/1993 | Lovell |

(Continued)

FOREIGN PATENT DOCUMENTS

EP 0840264 A1 6/1998

(Continued)

OTHER PUBLICATIONS

Doc. No. 03-199, English-language translation of Official Action in regard to Russain counterpart (12 pages)—Available Nov. 2, 2005.

(Continued)

*Primary Examiner*—M. Sager
(74) *Attorney, Agent, or Firm*—K&L Gates LLP

(57) ABSTRACT

Techniques for providing a streak game are described. A streak wager on a streak game is received and a representation of the streak wager is displayed. The streak game is made up of a number of consecutive main games and a selected outcome for each main game. An outcome of a main game is received. Whether the received outcome is the same as the selected outcome for the main game associated with the streak game is determined. The number of received consecutive outcomes that are the same as the selected outcomes for the main game associated with the streak game is tracked. If more than one streak game is in play at the same time, the streak games are each individually tracked. A new streak wager can be placed at any time, such that one streak wager need not be completed before a new streak wager is received.

59 Claims, 15 Drawing Sheets

U.S. PATENT DOCUMENTS 5,393,057 A 2/1995 Marnell, II
5,501,455 A 3/1996 Hirata et al.
5,531,448 A 7/1996 Moody
5,570,885 A 11/1996 Ornstein
5,586,766 A * 12/1996 Forte et al. ..... 273/309
5,664,998 A 9/1997 Seelig et al.
5,718,431 A 2/1998 Ornstein
5,728,002 A 3/1998 Hobert
5,732,950 A 3/1998 Moody
5,788,573 A 8/1998 Baerlocher et al.
5,788,574 A 8/1998 Ornstein et al.
5,810,354 A 9/1998 Banyai
5,823,873 A 10/1998 Moody
5,829,748 A 11/1998 Moore, Jr.
5,851,010 A * 12/1998 Feinberg ..... 273/274
5,890,962 A 4/1999 Takemoto
5,947,820 A 9/1999 Morro et al.
5,980,384 A 11/1999 Barrie
5,996,997 A 12/1999 Kamille
5,997,400 A 12/1999 Seelig et al.
5,997,401 A 12/1999 Crawford
6,019,369 A 2/2000 Nakagawa et al.
6,024,642 A 2/2000 Stupak
6,039,649 A 3/2000 Schulze
6,053,813 A 4/2000 Mathis
6,059,289 A 5/2000 Vancura
6,079,711 A 6/2000 Wei et al.
6,089,977 A 7/2000 Bennett
6,102,400 A 8/2000 Scott et al.
6,102,402 A 8/2000 Scott et al.
6,102,798 A 8/2000 Bennett
6,142,874 A 11/2000 Kodachi et al.
6,155,925 A 12/2000 Giobbi et al.
6,159,095 A 12/2000 Frohm et al.
6,159,098 A 12/2000 Slomiany et al.
6,168,520 B1 1/2001 Baerlocher et al.
6,168,523 B1 1/2001 Piechowiak et al.
6,190,254 B1 2/2001 Bennett
6,190,255 B1 2/2001 Thomas et al.
6,203,428 B1 3/2001 Giobbi et al.
6,203,429 B1 3/2001 DeMar et al.
6,203,430 B1 3/2001 Walker et al.
6,224,483 B1 5/2001 Mayeroff
6,254,481 B1 7/2001 Jaffe
6,279,910 B1 8/2001 de Keller
6,315,660 B1 11/2001 DeMar et al.
6,319,122 B1 * 11/2001 Packes et al. ..... 463/16
6,322,309 B1 11/2001 Thomas et al.
6,347,996 B1 2/2002 Gilmore et al.
RE37,588 E 3/2002 Ornstein
6,394,902 B1 5/2002 Glavich et al.
6,398,645 B1 6/2002 Yoseloff
6,409,172 B1 6/2002 Vancura
6,439,995 B1 8/2002 Hughs-Baird et al.
6,494,785 B1 12/2002 Gerrard et al.
6,511,068 B1 1/2003 Sklansky et al.
6,511,375 B1 1/2003 Kaminkow
6,595,854 B2 7/2003 Hughs-Baird et al.
6,602,136 B1 8/2003 Baerlocher et al.
6,645,074 B2 11/2003 Thomas et al.
6,648,757 B1 11/2003 Slomiany et al.
6,652,378 B2 11/2003 Cannon et al.
6,656,040 B1 12/2003 Brosnan et al.
6,656,044 B1 12/2003 Lewis
6,669,559 B1 12/2003 Baerlocher et al.
6,679,492 B2 1/2004 Markowiak
6,695,696 B1 2/2004 Kaminkow
6,786,820 B2 9/2004 Gerrard et al.
6,802,773 B2 10/2004 Moody
6,808,454 B2 10/2004 Gerrard et al.
6,837,793 B2 1/2005 McClintic
6,857,958 B2 2/2005 Osawa
6,869,357 B2 3/2005 Adams
6,878,061 B2 4/2005 Baerlocher et al.
6,908,383 B2 6/2005 Baerlocher et al.
6,932,702 B1 8/2005 Harris
7,029,395 B1 4/2006 Baerlocher
7,052,392 B2 5/2006 Tessmer et al.
7,416,485 B2 8/2008 Walker et al.
7,470,197 B2 12/2008 Massey et al.
2001/0028147 A1 * 10/2001 Ornstein et al. ..... 273/292
2002/0010018 A1 1/2002 Lemay et al.
2002/0045474 A1 4/2002 Singer et al.
2002/0155881 A1 10/2002 Yoshida
2002/0177483 A1 11/2002 Cannon
2003/0027626 A1 2/2003 Marks et al.
2003/0060266 A1 3/2003 Baerlocher
2003/0060268 A1 3/2003 Falconer
2003/0069068 A1 4/2003 Kaminkow
2003/0236115 A1 12/2003 Chamberlain
2004/0204218 A1 10/2004 Hughs-Baird
2005/0233796 A1 10/2005 Baerlocher et al.
2006/0030399 A1 2/2006 Baerlocher

FOREIGN PATENT DOCUMENTS

EP 0874337 A1 10/1998
EP 0945837 A2 9/1999
EP 0984409 A2 3/2000
GB 1202 691 8/1970
GB 1262134 2/1972
RU 17678 U1 4/2001
WO WO 97/27570 7/1997
WO WO 9732285 9/1997
WO WO 99/10849 3/1999
WO WO 00/12186 3/2000
WO WO 02/099760 12/2002
WO WO 03/083795 10/2003

OTHER PUBLICATIONS

Doc. No. 03-343, PCT International Search Report issued in PCT/US02/11156, Dec. 4, 2002.

* cited by examiner

INTERACTIVE STREAK GAME

This application claims the benefit of U.S. Provisional Application No. 60/411,849, filed on Sep. 18, 2002, which is hereby incorporated by reference in its entirety.

BACKGROUND

The present specification relates to gaming.

Wagering on games of chance can be a form of entertainment and recreation, as well as a source of profit for establishments that provide the games (referred to in this specification as the house). There are different types of games of chance, examples of which include and are not limited to craps, blackjack, roulette, baccarat, poker, keno, bingo, progressive jackpots, and streak games.

In general, an instance of a game of chance, referred to in this specification as a round, is defined as play when one or more participating players place wagers and when an outcome of the instance of the game is or can be determined in accordance with the rules of the game. An outcome of the instance of the game, i.e., the outcome of the round or simply an outcome, can usually be defined by who wins among the players participating in the round, what each winning player wins, who loses among the players participating in the round, what each losing players loses, who ties among the players participating in the round (if a tie is permitted by the rules of the game), and any combination of the aforementioned.

An outcome generally depends, at least in part, on an outcome of some random outcome generator. An outcome of a random outcome generator will be referred to in this specification as an ROG result. Examples of random outcome generators include and are not limited to dice, cards, a roulette wheel, a computer program product driven by a random or pseudo-random number generator, and a sporting event (for example, a horse race). An outcome can depend on one ROG result. Roulette, for example, is a game of chance in which an outcome can depend on a single ROG result, one spin of the roulette wheel. Alternatively, an outcome can depend on multiple ROG results. Blackjack, for example, is a game of chance in which an outcome can depend on multiple ROG results. A game of blackjack includes dealing multiple cards from one or more decks of cards.

A wager can be an agreement between a player and an entity offering the game of chance. Wagers are usually but need not be made on a round-by-round basis. The entity offering the wager can be a player. The agreement can specify that the player forfeits a stake if the player loses in exchange for an opportunity to win a multiplier, which can be any number, of the stake if the player wins. The agreement is usually based on whether the player wins, loses, or ties.

The stake required for participation in a round is usually, but need not be, of some particular denomination of money or points. Games of chance implemented as slot machines, for example, can receive denominations of nickels, quarters, dollars, and so forth. Here, as with other games of chance, a player may increase the stake placed by adding a stake in the appropriate denomination, which increase usually enhances the player's chances of winning, such as in blackjack when a player splits pairs, or increases the payout if the player wins.

A streak game is one type of game of chance. In streak game round, a participating player can win when a combination of selected outcomes or ROG results occurs, usually consecutively. The combination of outcomes or ROG results on which an outcome of a round of a streak game is based will be referred to in this specification as a streak combination. A streak combination can include any combination of outcomes of a game of chance. A streak combination, for example, can include a player winning three consecutive games of poker, winning five consecutive games of poker, or achieving two of a kind in two consecutive games. A streak combination can apply to any type of ROG result. A streak combination, for example, can include the roulette ball landing on an even number two times in a row or landing on a number between 19 and 36 twice in a row. Different streak games can be based on different streak combinations.

When the outcome of a streak game depends on outcomes of a particular game of chance, the streak game is usually referred to as a side game and the particular game of chance is usually referred to as a main game. In video poker, for example, the poker game itself can be a main. game and a streak game, which outcome is based on two or more main rounds, can be the side game.

A streak game that is a side game to video poker, for example, can proffer a streak combination, for example, a flush in two consecutive games. The player is usually allowed to place a side game wager on the streak combination at the beginning of a streak round. After the round begins, no further side game wagering is allowed. That is, the player cannot place additional side game wagers or remove wagers already placed until the streak round has been completed. A streak round (which outcome can be based on a particular streak combination), begins when a player places a wager (wagering that the particular streak combination will occur and selecting a stake for the streak round) and ends when the outcome of the streak round is determined (when it can be determined that the particular streak combination or combinations either cannot or has occurred). Thus, in the example above, the streak round ends after the two rounds of video poker, when it can be determined the streak combination cannot or has occurred.

Streak wagering can be offered without requiring the player to place a main game wager. For example, a player wagering on two consecutive roulette outcomes, for example two red outcomes, does not need to place a wager on the main roulette game.

SUMMARY

The present specification describes methods and apparatus, including computer-program products, for providing an interactive streak game.

In general, in one aspect, the invention features methods and apparatus, including computer program products, for providing a streak game. A streak wager on a streak round is received and a representation of the streak wager is displayed. The streak round is made up of a number of consecutive main rounds and a selected outcome for each main round. An outcome of a main round is received. Whether the received outcome is the same as the selected outcome for the main round associated with the streak round is determined. The number of received consecutive outcomes that are the same as the selected outcomes for the main round associated with the streak round is tracked. If more than one streak round is in play at the same time, the streak rounds are each individually tracked.

In general, in another aspect, a new streak wager can be placed at any time, such that one streak round need not be completed before a new streak wager is received.

Particular implementations can include one or more of the following features. An end of the streak round can be indicated. A player playing the streak round need not play the main round. The representation of the streak wager can indicated a point value or a monetary value of the wager. A payout that is based on the number of consecutive main rounds that make up the streak round can be determined. More than one streak round can be in play at the same time. When multiple streak rounds are in play, each streak round can be made up of the same number of associated main rounds or a different number of associated main rounds. A single main round can be associated with multiple streak rounds. Tracking the outcomes can include moving a representation of the streak wager or stake from one position to a next position.

An apparatus for wagering on the streak game can include a display with positions into which a representation or a wager or a stake can be moved to indicate progress in a streak round. The apparatus can have a representation of a wager. The representation of the wager can be electronic, a chip, a game piece, or the representation can identify a player. The display can be an electronic display, or a physical display, such as a table, a wheel, a pit, or cards. The display can be printed on a table or table covering or can be a three dimensional structure. The display can have a number of positions that correlate to the number of consecutive main rounds that make up the streak round. The positions can be linearly aligned or aligned in an arc or any other geometric configuration. The display can include a graph, such as, for example, a bar graph, or a chart, such as, for example, a pie chart. The display can be electronic and the positions can make up an image.

Methods and apparatus described in this specification can be implemented to realize one or more of the following advantages. A system configured as described in this specification can individually track and indicate round progress of rounds placed on different streak combinations while multiple streak rounds are in play at the same time for a single player. When a wager is placed, the progress along the streak round can be clearly displayed. The display can be simple and easy for a player to follow.

During a streak round, the system can allow the player to place additional wagers after each main round or after each ROG result. The system, for example, can allow the player to place a first wager on a first streak combination at the beginning of the streak round and place a second wager on the same streak combination after one main round and while the first streak round is still in play (before the end of the first streak round). More than one streak round can be associated with a single main round.

The system provides a position into which a representation of the streak wager, the stake or representation of the stake is moved to indicate the progress of achieving a streak combination. For a streak round of blackjack which outcome is based on a streak combination of a two consecutive blackjack wins, for example, the system can provide a first position into which the stake is moved after the first blackjack win, at which point, a new side game wager can be placed. This feature is available for streak rounds having multiple streak combinations as well as for streak rounds having only one streak combination.

Side games can be offered with multiple independent streak wagers, for example, a wager for two wins in a row, a wager for three wins in a row and a wager for four wagers in a row can all be in play at the same time. The player can place wagers on any number of streak wagers and does not need to wait until a streak wager that has been placed is resolved before placing a new streak wager on the same or different streak combination.

Methods and apparatus as described in this specification can be implemented in an electronic game, for example, a video game, and in a live gaming apparatus, for example, a gaming table and a gaming pit.

A stake can be represented by one or more elements, for example, one or more casino chips, or an electronic readout. The stake or its representation can be moved manually, mechanically, electromechanically, electrically, automatically, or in any combination of the aforementioned. The system can allow a player to place a streak wager that is a side wager without playing the main round.

The details of one or more implementations of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
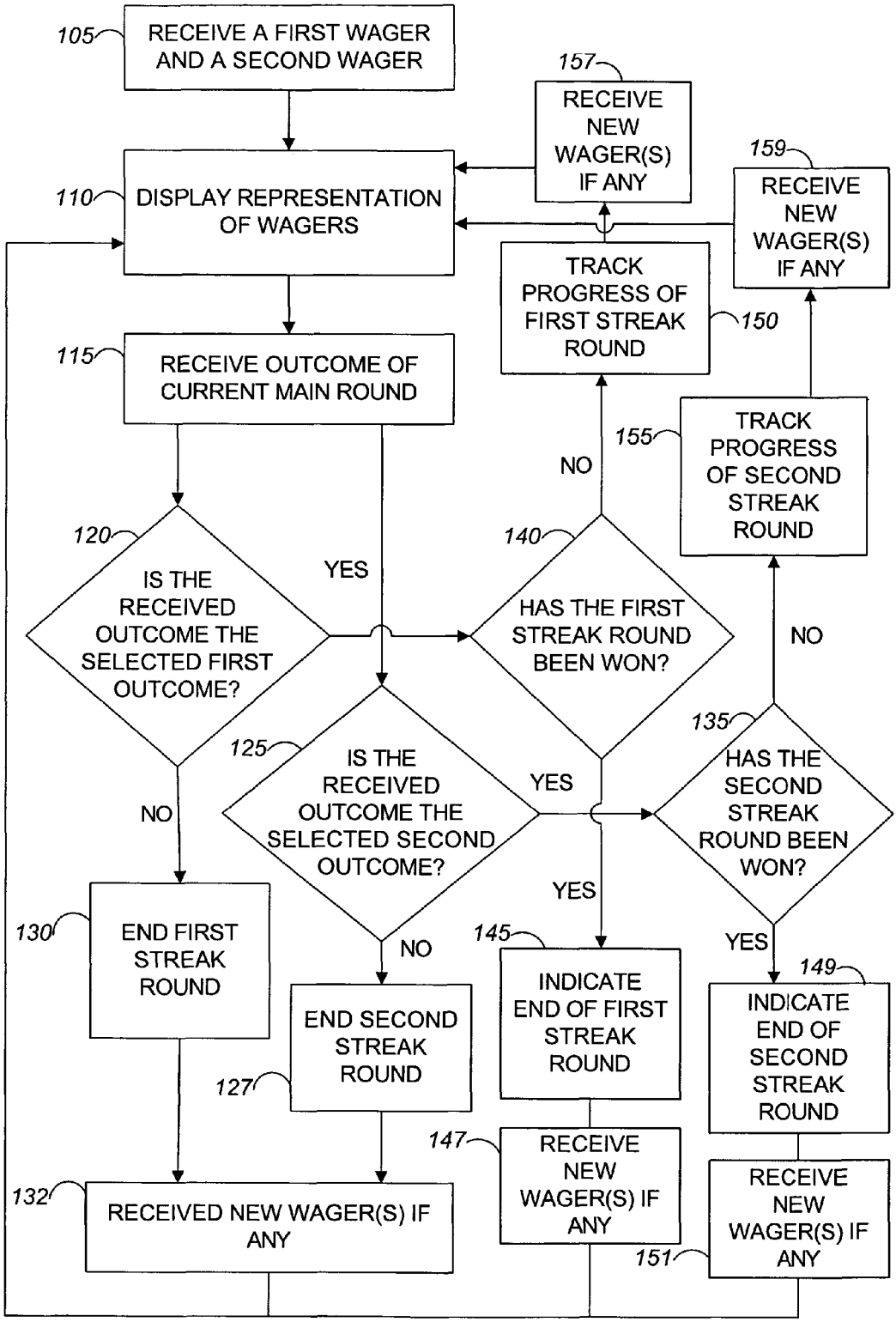
FIG. 1 shows a method for providing streak rounds where multiple streak rounds can be tracked independently.

As shown in FIG. 1, a first wager on a first streak round and a second wager for a second streak round are received (step 105). The wager on the streak round will be referred to as a streak wager. Each of the streak wagers are for a streak combination, such that each streak wager is placed on a number of main rounds that make up the streak round and an outcome for each main round. Each of the streak wagers can be placed on different outcomes, a different number of main rounds making up the streak round, the same outcome, or the same number of main rounds making up the streak round, in any combination. The outcome can be a default outcome and not selected by the player, such as, for example, a particular player winning the round. Alternatively, an outcome for each main round can be selected by the player, such as, for example, rolling dice. A representation of each streak wager for each corresponding streak round is displayed (step 110). The representation of a streak wager can be a stake, e.g., U.S. currency, or a representation of the stake, e.g., one or more casino chips. The area where the representation of the streak wagers are displayed is a streak game area.

A main round is played according to the rules of the main game. The main game can be provided by the same entity offering the streak game, but need not be. The outcome of the round is determined, generally by the ROG result. For some main games, multiple ROG results are used to determine the outcome. The outcome of the main round is received (step 115).

The first selected outcome for the first streak round is compared to the received outcome (step 120). If the two outcomes are dissimilar, the first streak wager is ended, for example, the stake for the first streak wager can be collected (step 130). Conversely, if the two outcomes are the same, a determination is made whether the first streak round has been won (step 140). In order for a streak round to be won, the number of main rounds that make up the streak round must match the number of consecutive main rounds that have had outcomes matching the selected outcomes for each main round associated with the streak round and that have occurred since the streak wager was placed. If the two numbers match, or the streak combination is achieved, an end to the first streak round is indicated (step 145). The end of the streak round can be indicated by a payout, such as a payout of money, chips, points or a prize. Before or during the payout, a graphic or sound can notify the player of a successful completion to the streak round.

If the first streak round is not yet won, the first streak round is still in play and the progress of the first streak round is tracked (step 150). Because the streak game includes at least two main rounds, tracking the number of outcomes that are determined to be the same as the selected outcomes for the main round associated with the streak round aids the player and the entity providing the streak round in knowing how many more main rounds must have matching outcomes to the selected outcome for the streak round before the streak round is won.

The same analysis is also performed for the second streak round. The received outcome is compared to the selected outcome for the second streak round (step 125). If the two outcomes are not the same, the second streak round is ended (step 127). If the outcomes are the same, whether the second streak round has been won is determined (step 135). Whether the second streak round has been won is determined in the same way as the first streak round, using the number of main rounds that make up the second streak round. If the second streak round has been won, an end to the second streak round is indicated (step 145).

If the second streak round is not yet won, the progress of the second streak round is tracked (step 155). The streak wager on the first streak round and the streak wager on the second streak round are tracked individually. The streak wagers can each be placed on a different outcome or a different number of main rounds that make up each streak round. Thus, one streak round advancing does not necessarily mean that the other streak round advances. Tracking the two streak rounds individually allows one streak combination to be achieved, either due to a win or a loss, without affecting the other streak round.

After one of the streak rounds is ended or the progress of the streak rounds that are still in play has been tracked, new streak wagers on streak rounds can be received if there are any new streak wagers to receive (steps 132, 147, 151, 157 and/or 159). The new wagers can be received at any point after the outcome of the main round is received. The streak rounds that are still in play are displayed, along with any newly received wagers (step 110). The method continues until all the streak rounds are either won or lost. Tracking the first and second rounds continues as long as the rounds are in play. In addition, new added wagers on new streak game rounds are individually tracked. Any new wagers that are received can be for streak combinations that are the same as streak combinations that are currently in play. A player does not need to wait for one streak round ends before placing a streak wager on a new streak round with the same combination. In addition, the first streak wager can be received before a first main round occurs and the second streak wager can be received after the first main round occurs, thus the first and second streak wagers do not need to be received before the same main round. The first and second streak wagers can be on the same streak combinations or different streak combinations.

The streak game area used to display the one or more streak combinations can be proximate to the area where the main game is played, but need not be. If the streak game area is in the same area as the main game area, generally there is some form of delineation between the representation of the main wager and the representation of the streak wager, for example, indentations in the table where the stake is placed, graphics or borders around the streak game area, which can be flush with the streak game area or raised, or the difference from the main game area can be indicated by size, shape, or color differences between the two games, or a combination these attributes. In one implementation, the background or surrounding area of the main game area can indicate the streak game. The streak game area can be separated from the main game entirely, particularly when the streak game player is not playing the main game. The display can be either the same type of display as the display for the main game or a different type of display. If the display for the main game is a non-electronic display, for example, a table, the display for the streak game area can also be non-electronic, for example, a printed area on a table or card or a physical structure into which the wager can be placed. In an electronic implementation, for example, a video game, the display can be electronic. Even when the main game area is non-electronic, the streak game area can be electronic.

In addition, the representation of the streak wager can be physical and non-electronic, such as, for example, a chip, a game piece, a card, or a marker. Alternatively, the streak wager representation can be electronically represented, such as by an electronic graphic element. The display of both the streak game area and the representation of the streak wager can be available for the player of the streak game, the main game player (who may be the streak player), and the provider of the streak game to view, in any combination.

The area in which the representation of the streak wager is displayed can be visible throughout play of a round. Alternatively, the streak game area can be reduced or even disappear during play of the main game. Reducing or closing the display of the streak game area can allow for a larger main game area or just a simpler display. If the streak game area is in a reduced or in a hidden state, the representation of the streak wager or progress of the streak round can still be indicated to the streak game player. The streak round progress or representation of the streak wager can be shown using visual indicators that appear on the main game area, such as, for example, a border with a graphic, a miniature grid reflecting the streak wager, color intensity, shading or texture, or text graphics that represent the streak wager. When the streak game area reduces in size, the display area can be shown sliding under the main game display area.

When a wager is placed on a streak combination that includes different outcomes for each main round that makes up the streak round, each outcome and its placement in the combination can be tracked. If a streak combination includes rolling a three followed by rolling sevens twice, if the ROG result is a three in the first main round that makes up the streak round, the outcome matches the selected outcome for the streak combination. The following main rounds only have matching outcomes to the streak round if the ROG result is a seven for each of the two main rounds. Thus, the placement of the outcome can be tracked in addition to the number of main rounds that make up a streak round and the outcomes that correspond to each main round.

Streak game progress can be tracked manually, by a mechanical device, by an electromechanical device or electronically. The tracking can be visible to the streak player, the house, or hidden. In a physical non-electronic implementation of the main game and streak game, a physical piece representing the streak wager can change, for example, the piece can change colors. If the display is electronic, a variety of representations can be used, such as, for example, a graphic, a bar graph or chart 360 being displayed on a screen. The chart may be a pie chart 364. In an implementation where a graphic of a graph 362 or chart 360 is used to indicate the tracked progress, before the first game the graph 362 or chart 360 can be empty or otherwise show that the streak round has not progressed beyond placing the streak wager. After a main round has occurred with an outcome that matches the selected outcome for a main round associated with the streak round, a portion of the graph 362 or chart 360 can be filled in to indicate the progress. In another implementation, the display can change colors or a sound can be played to indicate progress. In yet another implementation, lights are turned on and off to indicate progress. In an electronic version of the streak game, the tracking is stored in a memory and updated each time a main round is won or lost.

Figure 2:
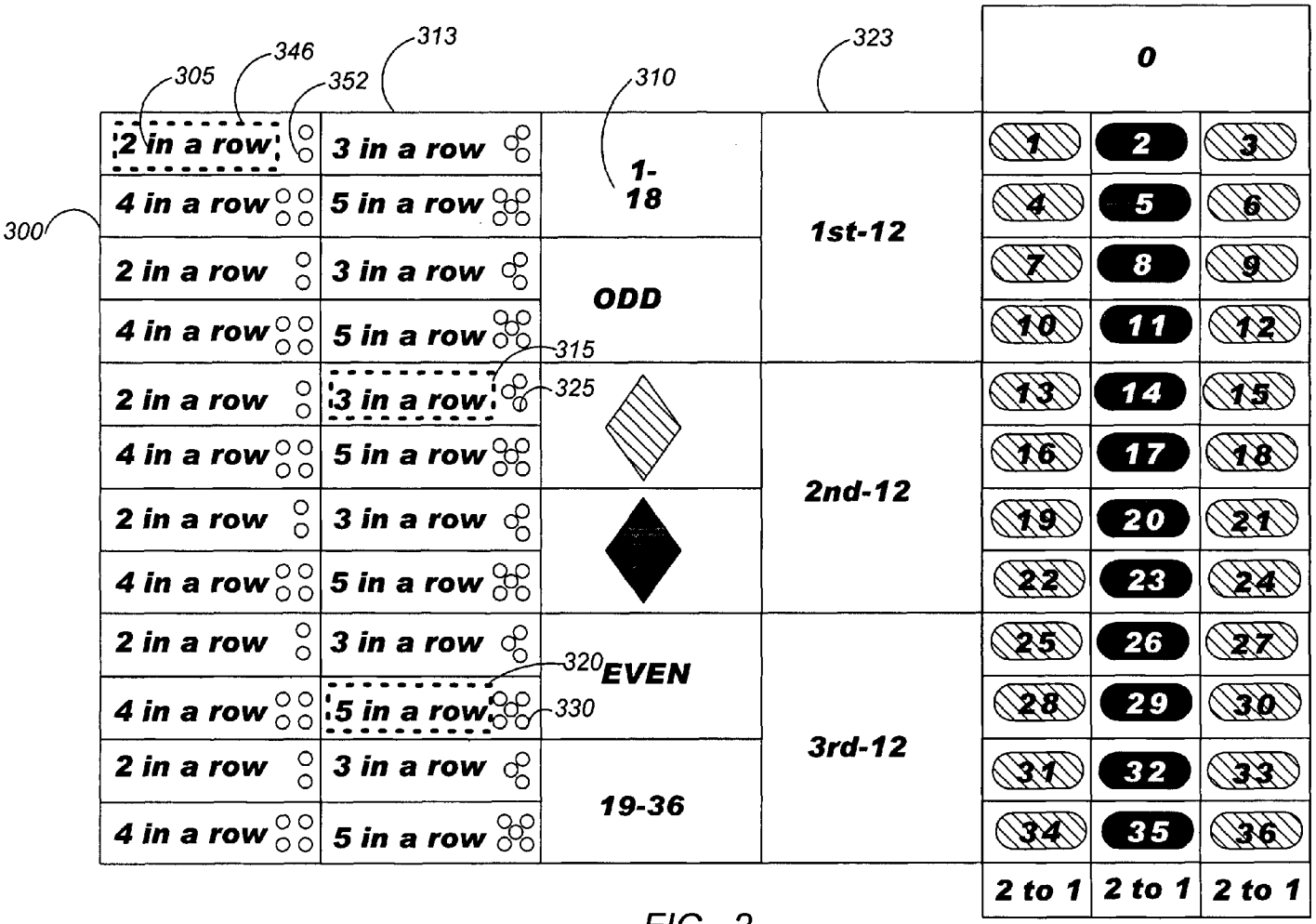
FIG. 2 shows an example of streak game tracking adjacent to a roulette wager area.

Various implementations of the method shown in FIG. 1 are described below. One implementation that can be used with a roulette game is shown in FIG. 2. The display shown is for an electronic table, but can also be used with a video game, or a non-electronic table. The game area 316 for the main game 323 is on one side of the display 300 and the streak game area 313 is adjacent to the main game area 323. A number of main rounds 305 and an outcome 310 can be selected. When the number of main rounds 305 and the selected outcome 310 that make up the streak combination are received, the streak combination 346 is indicated, such as by lighting the streak combination 346, which in the example shown indicates a streak combination of two consecutive rounds with outcomes between 1 and 18. If a second streak wager is placed for the streak combination of three main rounds and the outcome red, the streak combination 315 is lighted. If a first ROG result is a four red, the progress of each streak round can be tracked by lighting a first progress spot 352 for the streak combination 346 and a first progress position 325 for the streak combination 315. Before the next main round, but before the current streak rounds have ended, new streak wagers can be received. In the example shown, a streak wager for a streak combination 320 that is for five in a row even is received and the streak combination 320 is lighted. If the ROG result is eight black, the streak combination 346 streak round is won, the streak combination 315 streak round is lost, and the streak combination 320 progresses and the first progress spot 330 for the streak combination 320 is lighted. The streak rounds progress until no more streak rounds are in play.

Figure 3A:
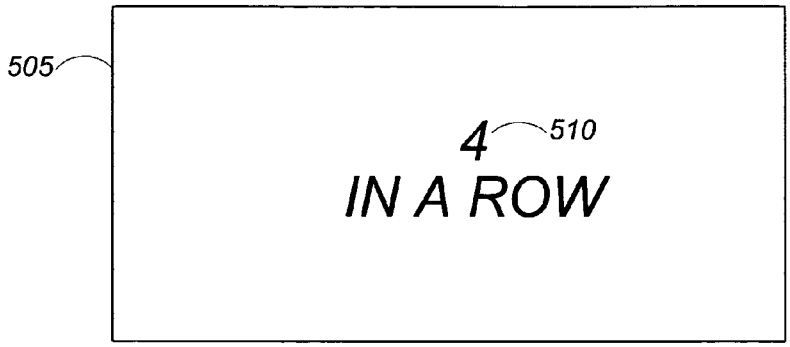
FIGS. 3A and 3B show an example of a graphic used to represent the streak wager.
Figure 3B:
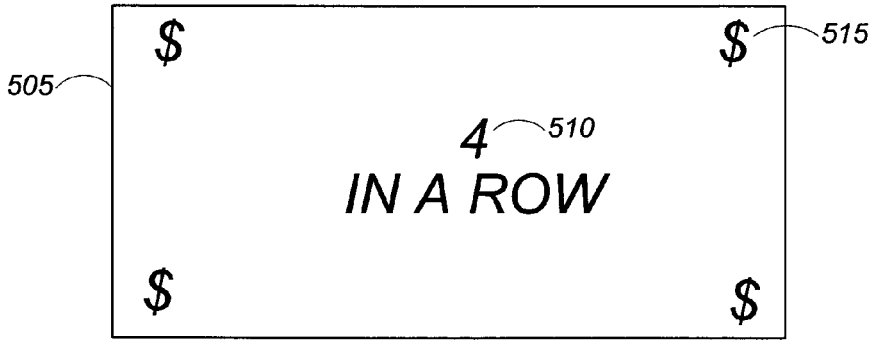

The streak round progress and representation of the streak wager can be shown graphically in a video game, as shown in FIGS. 3A and 3B. In an electronic representation of the streak game, the streak wager 505 and the number of main rounds 510 can be a represented by a graphic icon or a symbol. FIG. 3A shows the graphic representation of the streak wager after the wager has been received. Progress is then shown by changing the graphic 505, such as by adding a new element 515, as shown in FIG. 3B.

Figure 4:
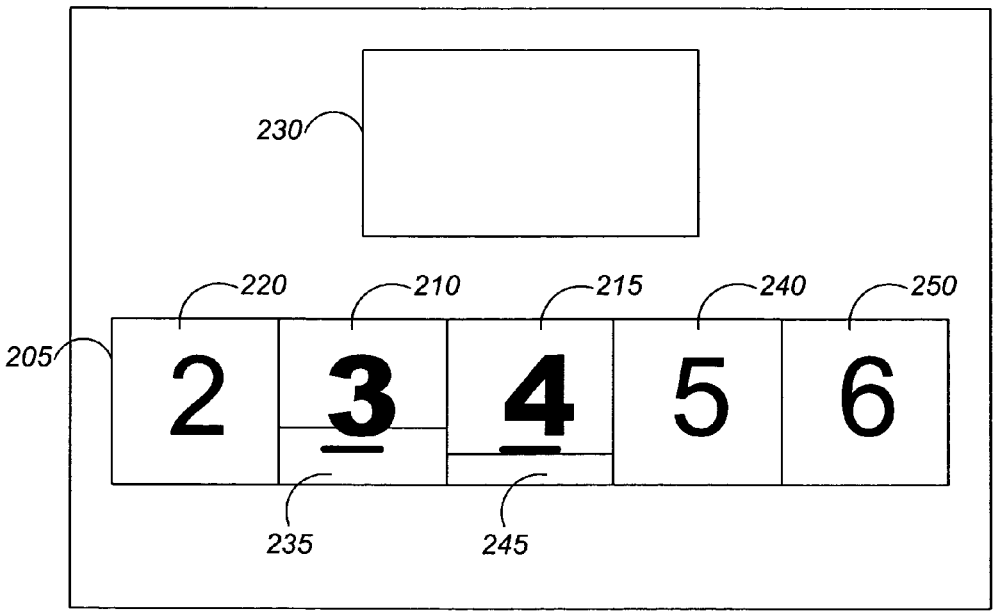
FIG. 4 shows an example of a streak game tracking display for multiple streak combinations.

In an implementation where the display for the streak game is a table, as shown in FIG. 4, the table can have a position that indicates the main game area 230 and numbers of main rounds 205. The streak wagers can be represented on positions that indicate the number of main rounds selected 210, 215, so that a viewer knows that a streak wager has been placed on a selected numbers of main rounds 210, 215 and not on unselected numbers of main rounds 220, 240 and 250. After progressing past a first main round, for the representation of the streak wager at position 210, a first portion 235 of the position 210 can be shaded to indicate that one-third of the progress has been made to winning the streak round. For the representation of the streak wager at position 215, a first portion 245 can be shaded to indicate that one-fourth of the progress has been made to winning the streak round.

Figure 5:
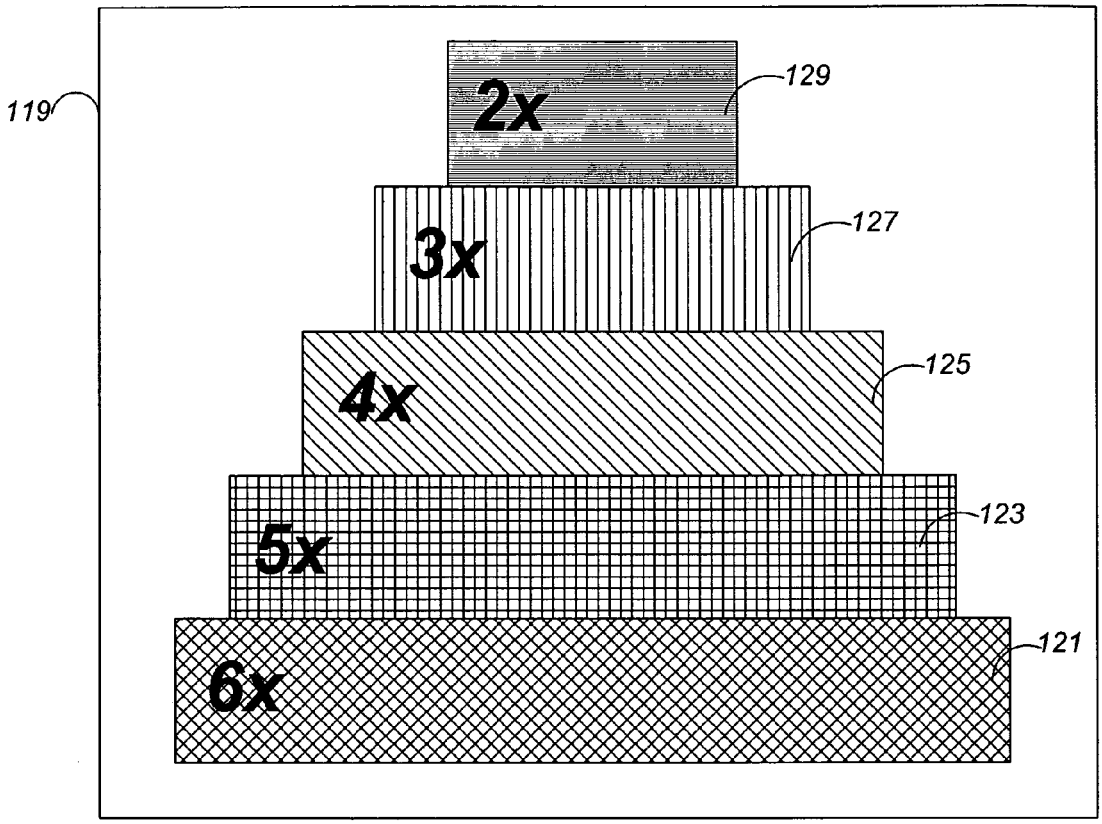
FIG. 5 shows a pyramid-style example of a streak game tracking display for multiple streak combinations.

FIG. 5 shows another implementation of a display 119 for streak games. In this implementation, a streak combination for two 129, three 127, four 125, five 123 or six 121 main rounds can be selected. As the streak round progresses, progress can be shown by filling in a portion of each streak combination area, such as a portion corresponding to the ratio of main rounds that have been played to the number of main rounds that was selected to make up the streak round, or changing the color of the streak combinations 129, 127, 125, 123 and 121 as progress is made.

Figure 6:
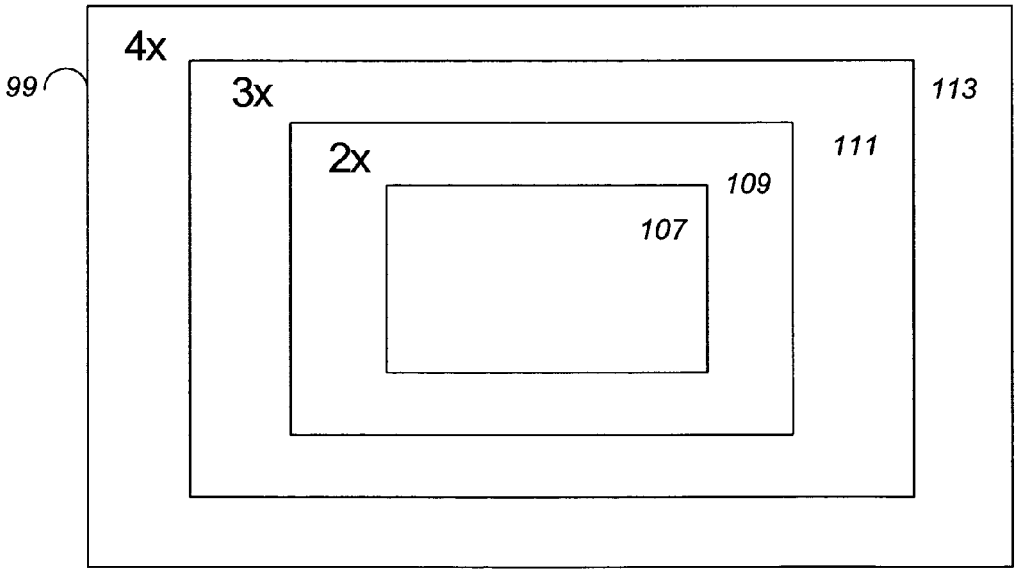
FIG. 6 shows a boarder-style streak game tracking display.

FIG. 6 shows an alternative layout for the streak wager area 99. Each streak combination 109, 111, 113 that is selected can be indicated by a color, texture, shading or other means of differentiating an active streak combination from an inactive streak combination. The center 107 can indicate a different streak combination, a main wager area, or not be used to indicate any type of wager, but instead can be used to indicate an event, for example, a successfully completion of a portion of the streak round, a loss, the ROG result or a win to a streak round.

Figure 7:
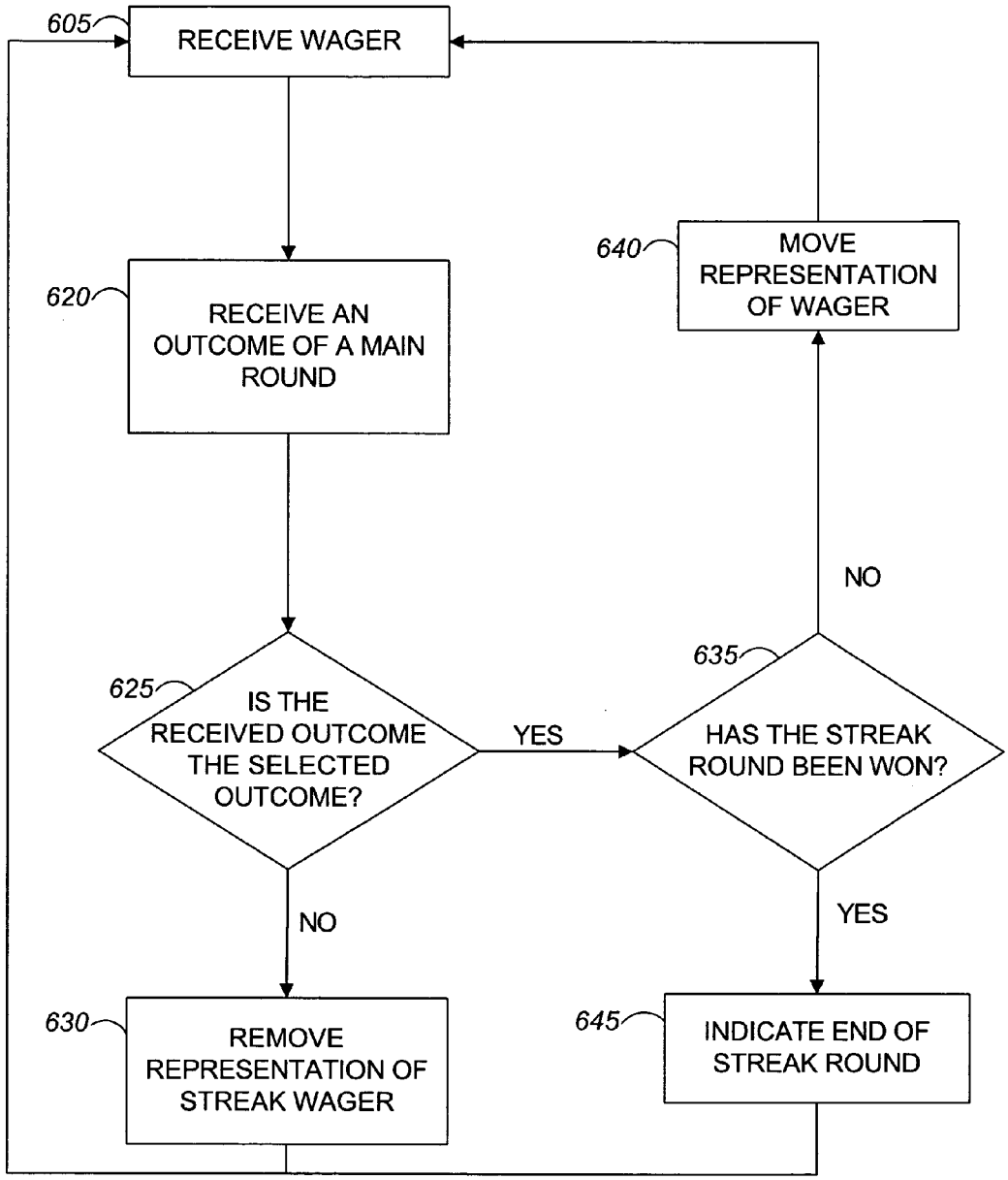
FIG. 7 shows a method of providing a streak game where multiple wagers on the same streak combination can be in play concurrently.

FIG. 7 shows another method of providing streak gaming, where multiple wagers on the same number of main rounds that make up each streak round can be in play so that one streak round overlaps another. A streak wager is received (step 605). The representation of the streak wager is displayed on the streak game area at a starting position (step 610). A main round is played and the outcome is determined. The outcome of the main round is received (step 620). The received outcome of the main round is compared to the selected outcome for streak round (step 625). If the received outcome is not the selected outcome, the stake is collected (step 630).

If the received outcome is the same outcome as the selected outcome for the streak round, whether the streak round has been won is determined in the same was as described above (step 635). Because only one main round has been played, the streak wager placed just before the main round was played is not yet won.

When the streak round has not been won yet, the representation of the streak wager is moved from the starting position to a new position, such as a progress position, to indicate progress in the streak round (step 640). The advancement can occur automatically, be controlled by the house, such as, for example, by a dealer, or by whatever entity is providing the streak game. A button, a lever or other mechanism can be activated to move or advance the representation of the streak wager to show the streak round progress. The representation of the streak wager can also be physically moved directly, manually or automatically, such as by being picked up or pushed into a next position. In electronic representations of the streak wager, a graphic can move one or more pixels to a new position to indicate progress.

The player can then place a new streak wager on a new streak round that begins with the next main round. Because the representation of the streak wager has been moved from the first position to the first progress position, a new streak wager for a streak round with the same streak combination as in the first streak round can be placed. In addition, streak wagers on any of the other streak combinations can concurrently be placed. For any one main round that is played, multiple streak rounds can be in progress and each of the streak rounds can depend on the outcome of the single main round.

Any new streak wagers are received (step 605). The representations of streak wagers for streak rounds that are still in play along with any representations of new streak wagers that may have been received are displayed (step 610). It is possible that for some main rounds, a streak round is in play for every available streak combination and at every progress position. An outcome for the current main round is received (step 620). Whether the outcome of the main round is the selected outcome for each streak round is determined (step 625). If after any main round the received outcome is not the selected outcome for any streak round, that representation of the streak wager is removed from the streak game area (step 630). The streak rounds having a selected outcome that matches the received outcome progress toward winning the streak round.

Figure 8A:
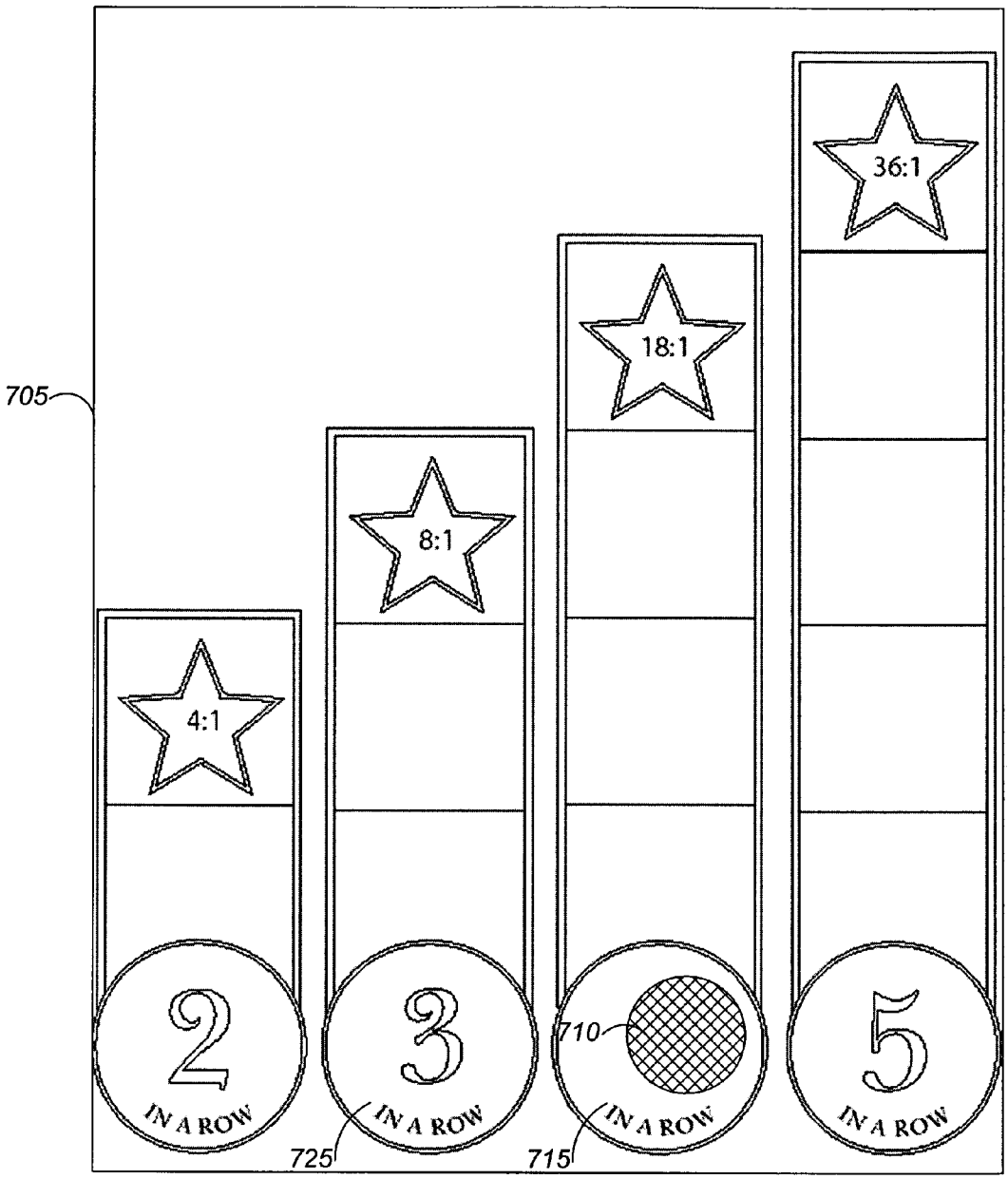
FIGS. 8A, 8B, 8C, 8D, 8E, 8F and 8G show stakes progressing along one implementation of a streak game display.
Figure 8B:
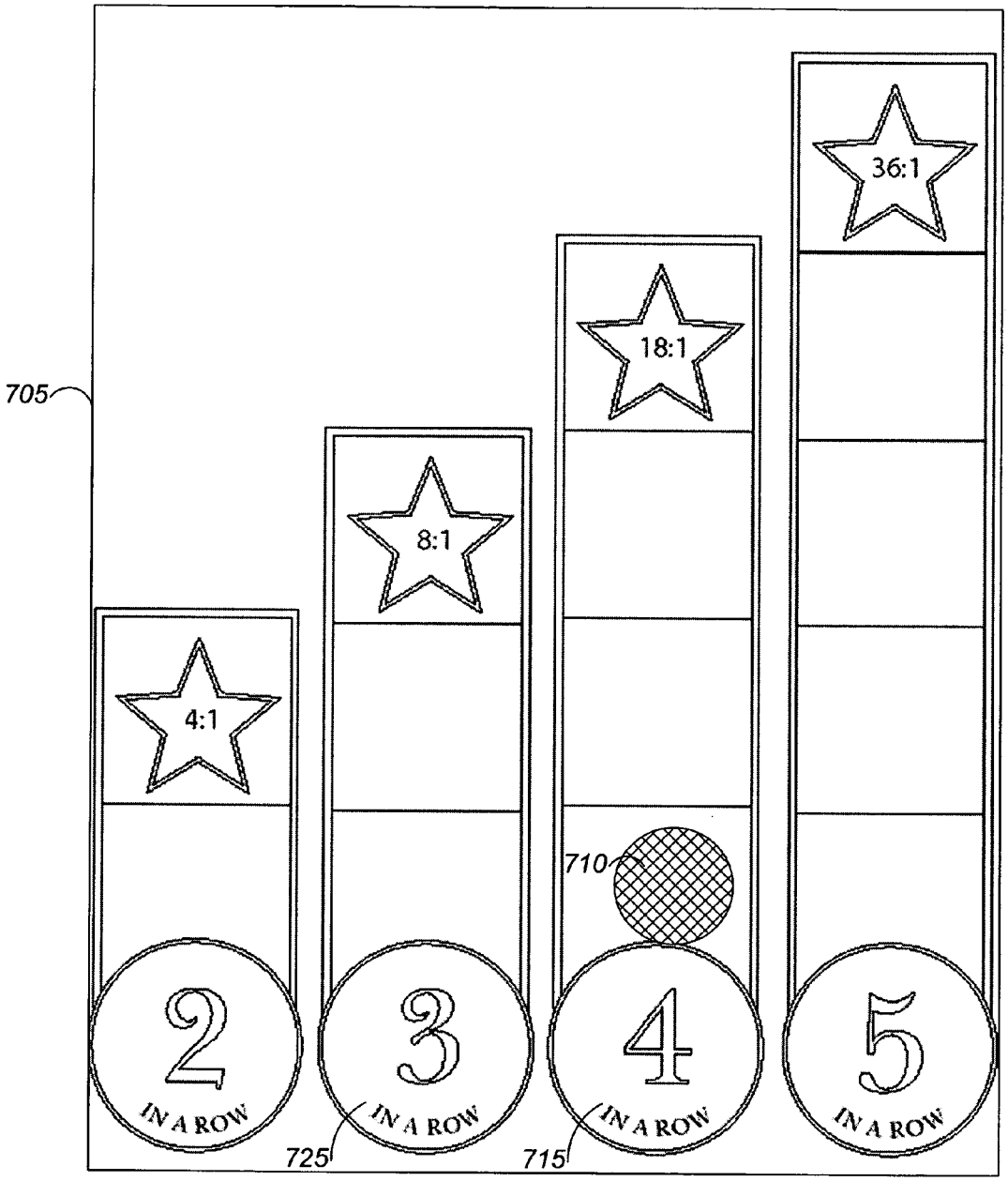
Figure 8C:
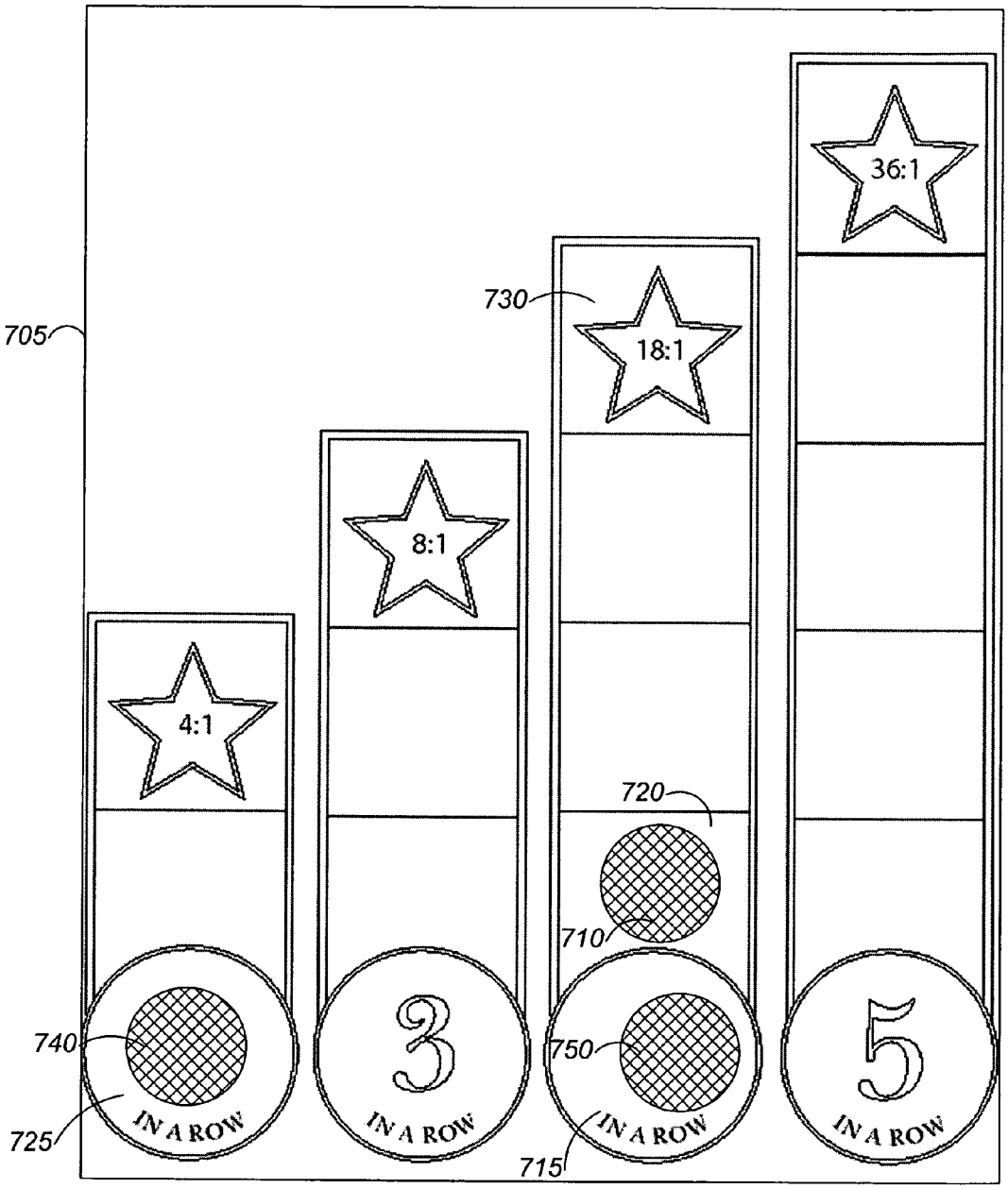

FIG. 8A shows one implementation of a streak game area 705. The implementation describes streak combination where the selected outcome is a win. However, any outcome can be substituted for a win, such as, a number, a color or a score. A first streak wager is received for a streak combination of four wins, which is indicated by a first position 715. A chip 710 for the first streak round is displayed at the first position 715. A first main round is played and the outcome is a win. As shown in FIG. 8B, the chip 710 for the first streak round is moved to position 720. New streak wagers are placed for a streak combination of two wins and a streak combination of four wins. As shown in FIG. 8C, on the streak game area 705 there is displayed the first chip 710 at position 720, indicating that the streak wager placed before the first main round has progressed, a chip 750 at position 715 and a chip 740 position 725 indicating streak wagers placed before a second main round have not yet progressed.

Figure 8D:
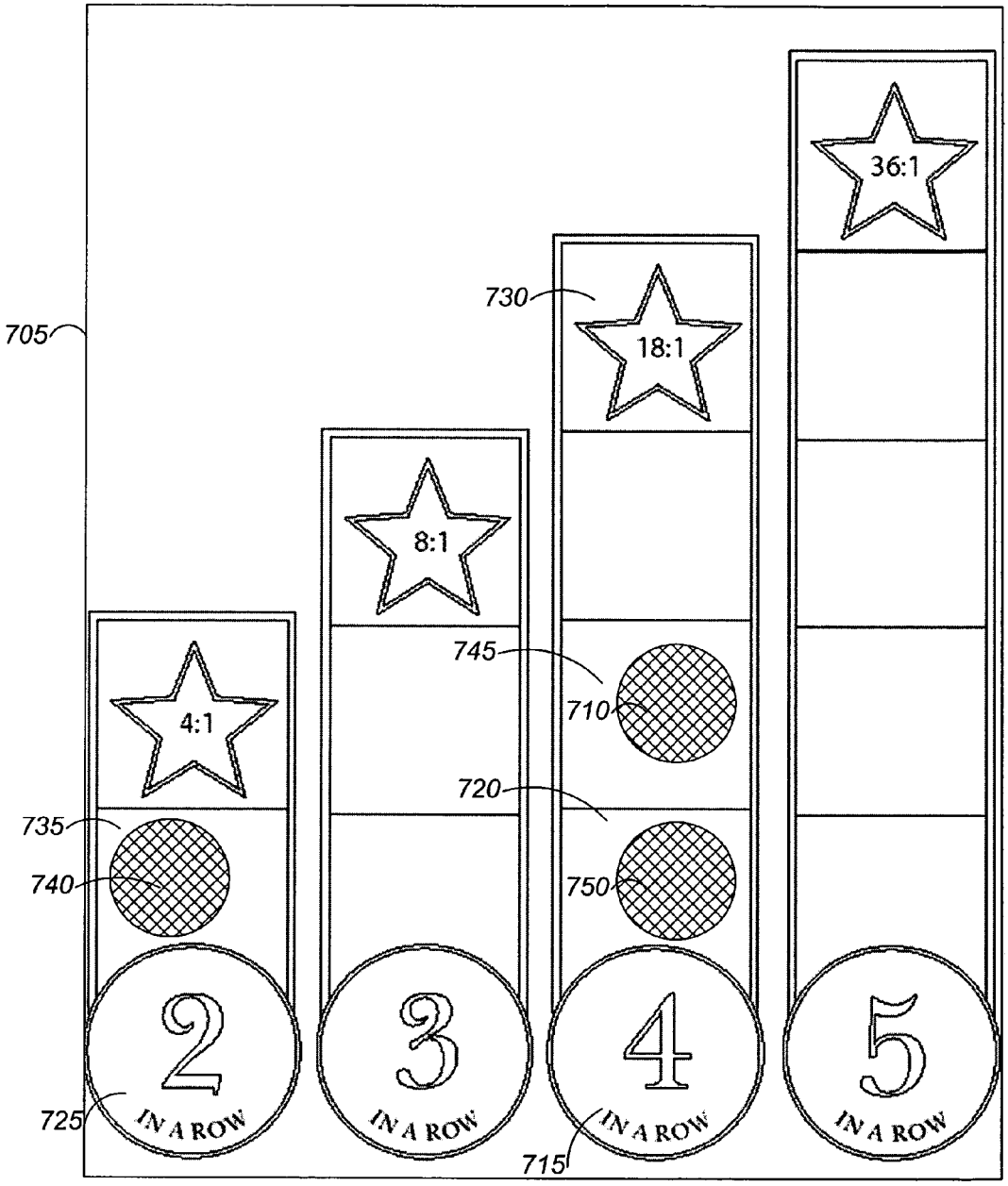
Figure 8E:
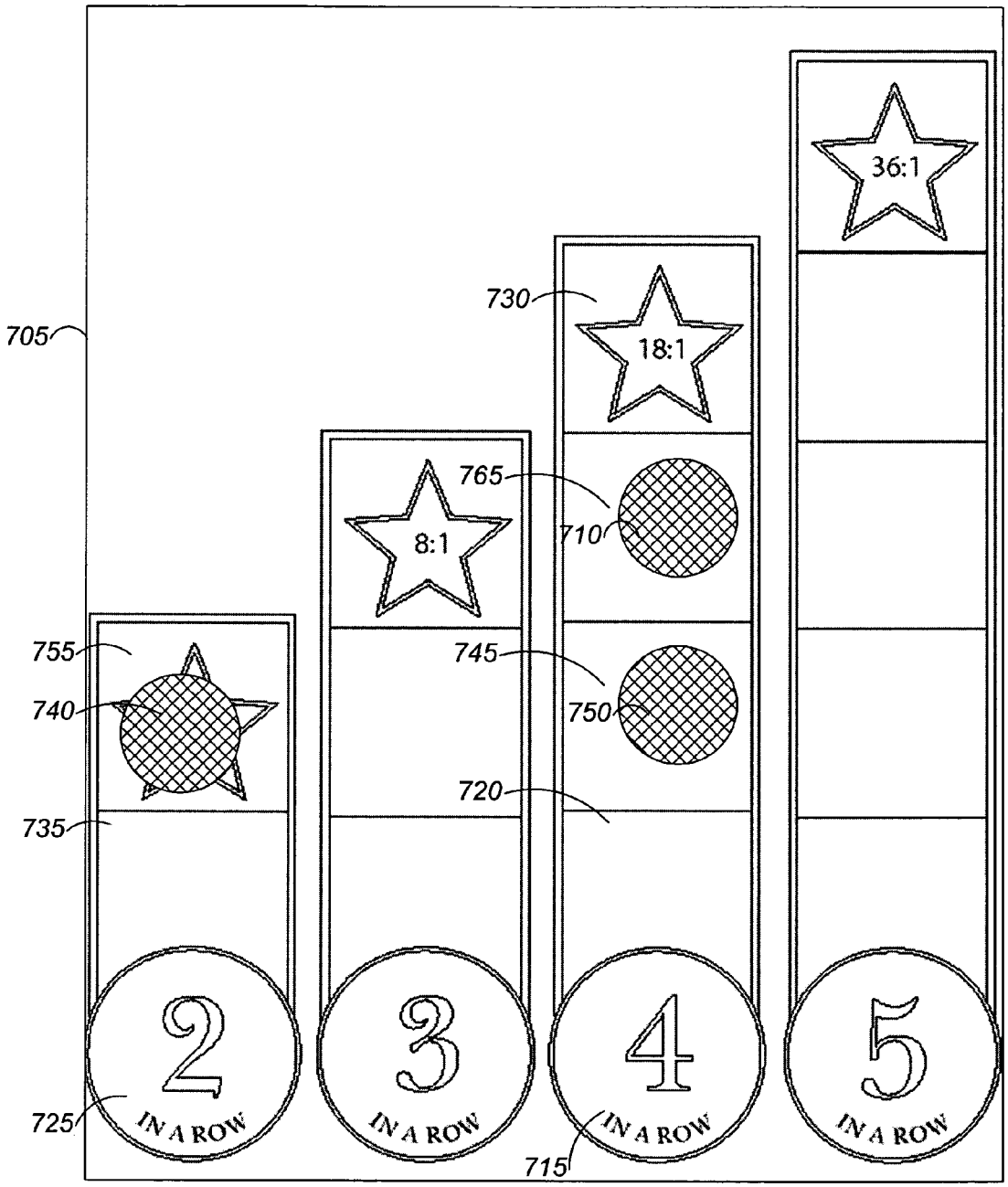

The second main round is played and the outcome is another win. The chips 710, 740 and 750 each advance one position, to positions 720, 735 and 745, as shown in FIG. 8D. The player decides not to place any additional streak wagers before the next main round begins. The next main round is played and the outcome is received. The received outcome again is a win, or matches the selected outcome for each of the main rounds for the streak combination. Each of the chips 710, 740 and 750 are again advanced, this time to positions 745, 755 and 765, as shown in FIG. 8E. The streak game area 705 can include a position 730 that indicates the streak round has been won when the chip 740 is moved into the position 730. Position 755 is the number of main rounds that make up the streak round 725. When the chip 740 moves into the position 755, the player and the house can see that the streak round has been won. The chip is given to the streak player, along with any winnings.

Figure 8F:
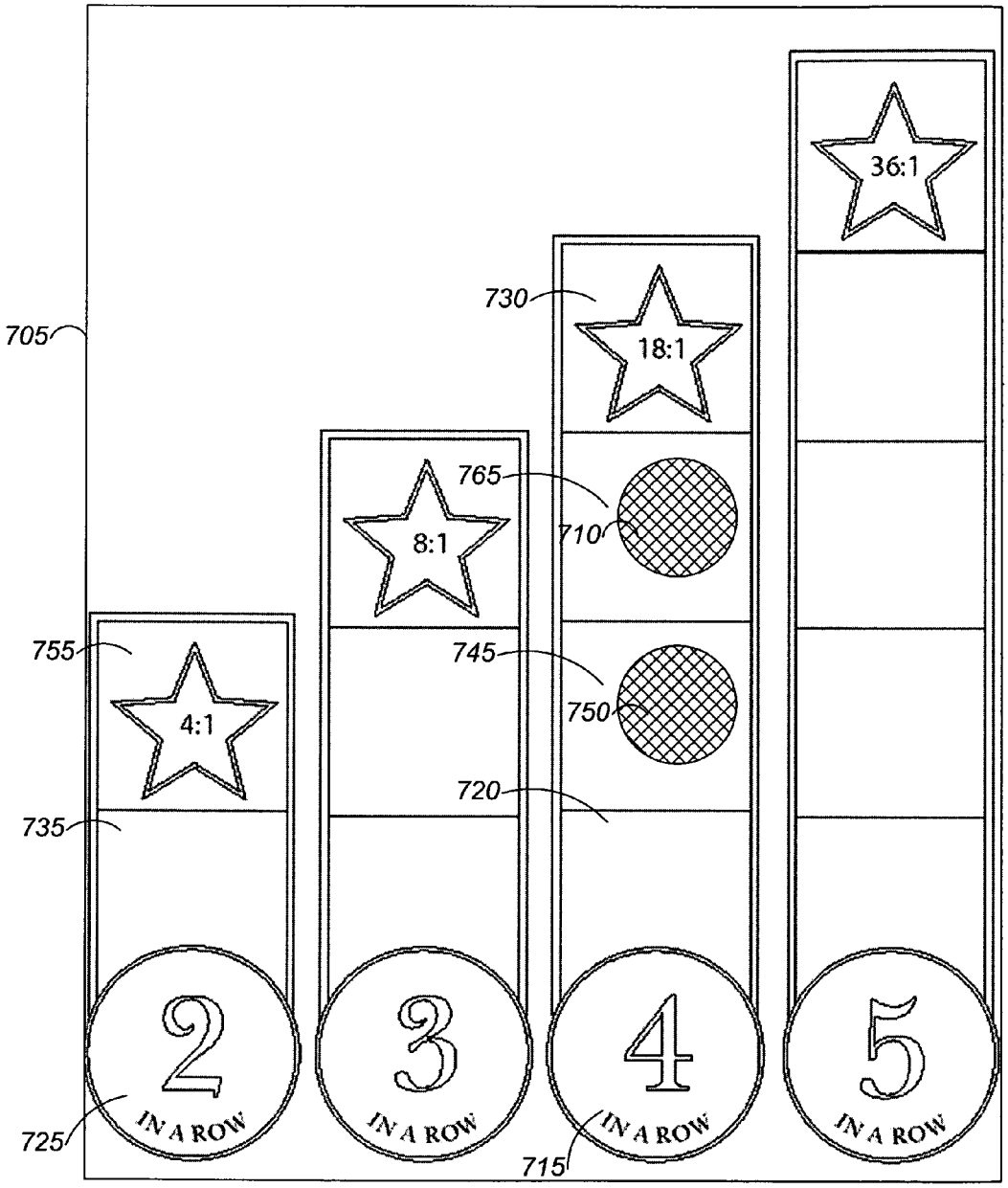
Figure 8G:
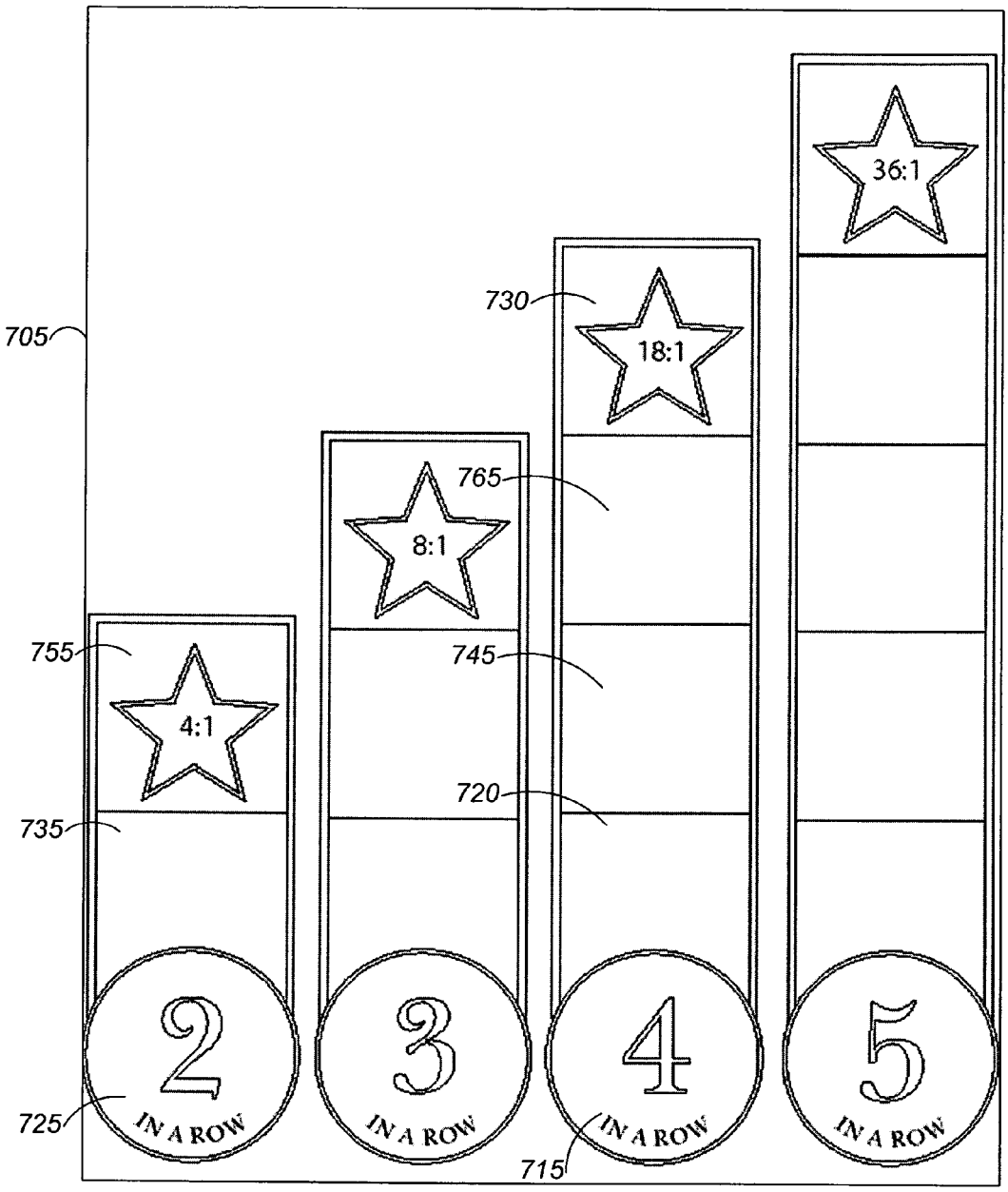

As shown in FIG. 8F, after the first streak round is won the chip 740 is no longer on the streak game area 705, but chips 710 and 750 are still in play and remain on the streak game area 705. Again, the player does not place a new streak wager. A new main round is played and the outcome is received. The outcome is not a win. Chips 710 and 750 are collected.

Figure 9:
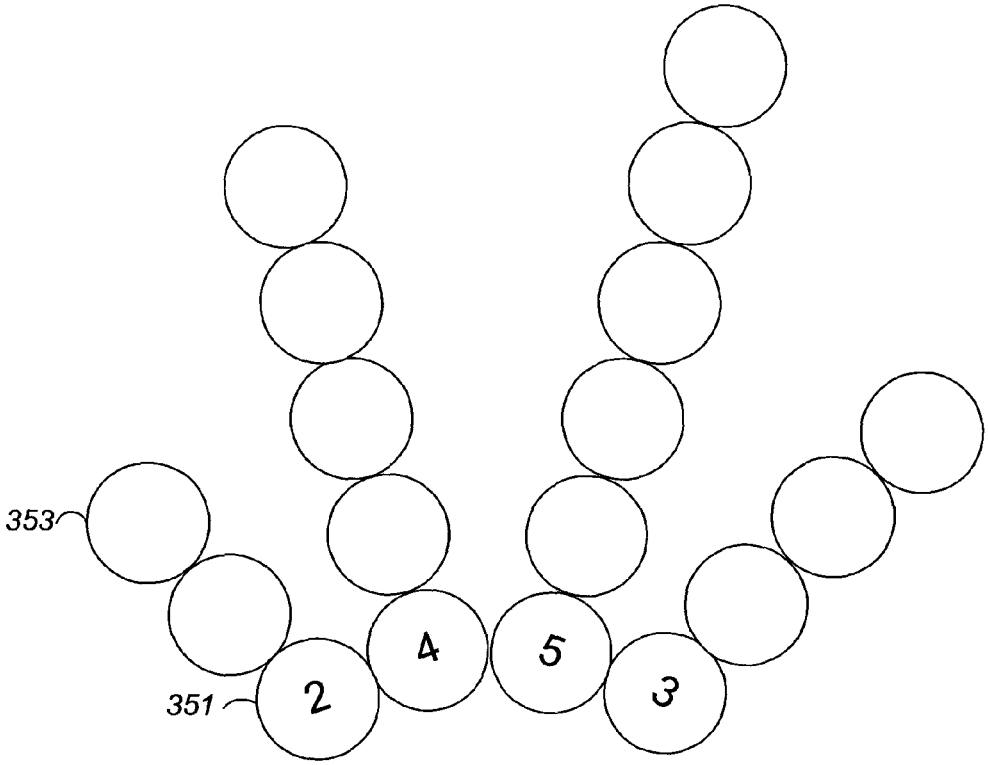
FIG. 9 shows an arc-shaped arrangement of progress positions.

As shown in FIG. 9, the progress positions for the streak games need not be linearly aligned. The starting positions 351 and progress positions 353 can be aligned in an arc and can be ordered out of numeric order.

Figure 10:
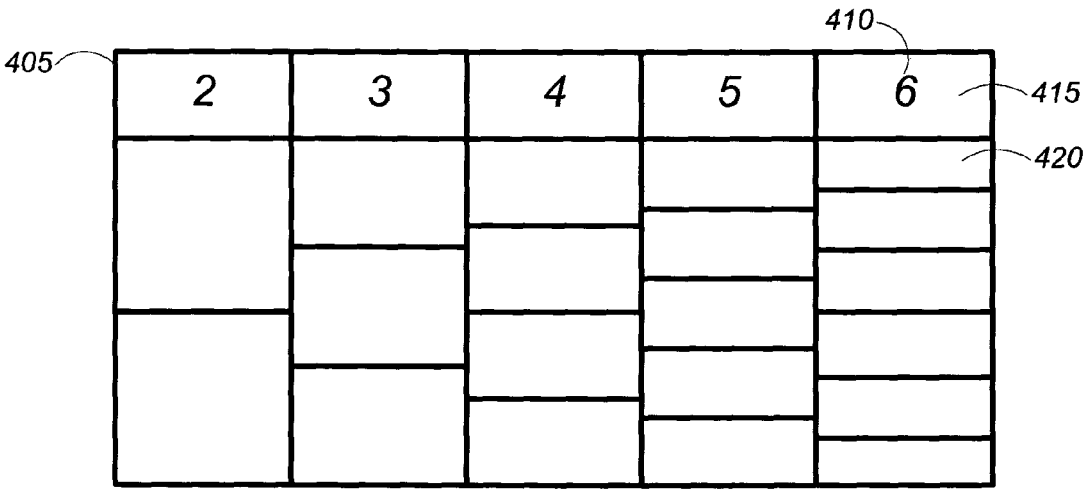
FIG. 10 shows an example of a stake holding structure.

In yet another implementation, as shown in FIG. 10, the representation of the streak wager, for example, a chip, is placed in a multi-slotted device 405 that is labeled with the number 410 of main rounds that make up the streak round. The chip can move from a first slotted area to a second slotted area 420 after progressing past a first main round. The multi-slotted device can be a three dimensional structure where the chips are aligned vertically or horizontally. After each main round, the chips can be moved automatically to the next position or moved by a control element, such as a lever, a lifting device, electrically, or by some other mechanism that moves the representation from one position to the next.

Figure 11:
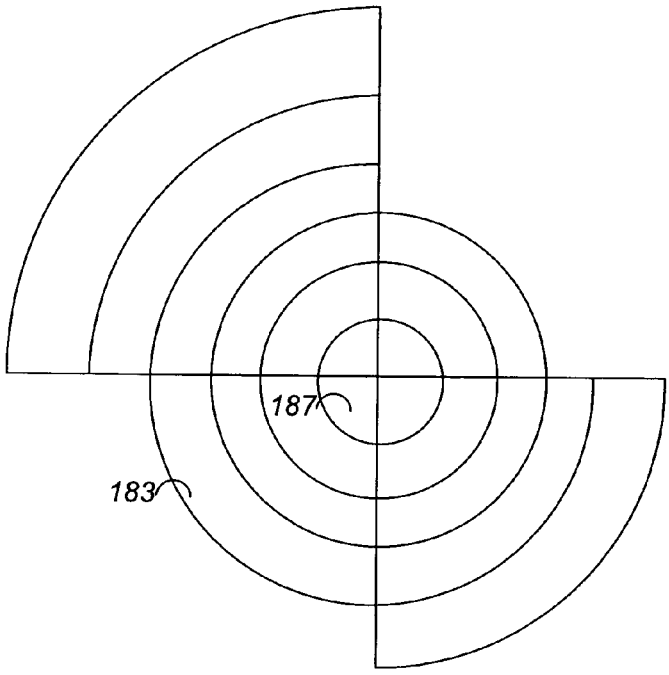
FIG. 11 shows a concentric circle version of the streak game display.

As shown in FIG. 11, a streak game area can be circular. In one version of this implementation, a representation of a streak wager can be placed in a subset 183 of a circle to show that the streak wager has been placed. As the streak round progresses through the selected number of main rounds, the representation of a streak wager is moved closer to the winning position 187 or outward. In another implementation, portions of the streak game area are filled in with color or shading to indicate that the streak round is in play and to show the progress in the streak round. This implementation can easily be displayed behind a main game area so that the streak round is discretely displayed during play of the main round, yet progress is easily observable.

Figure 12:
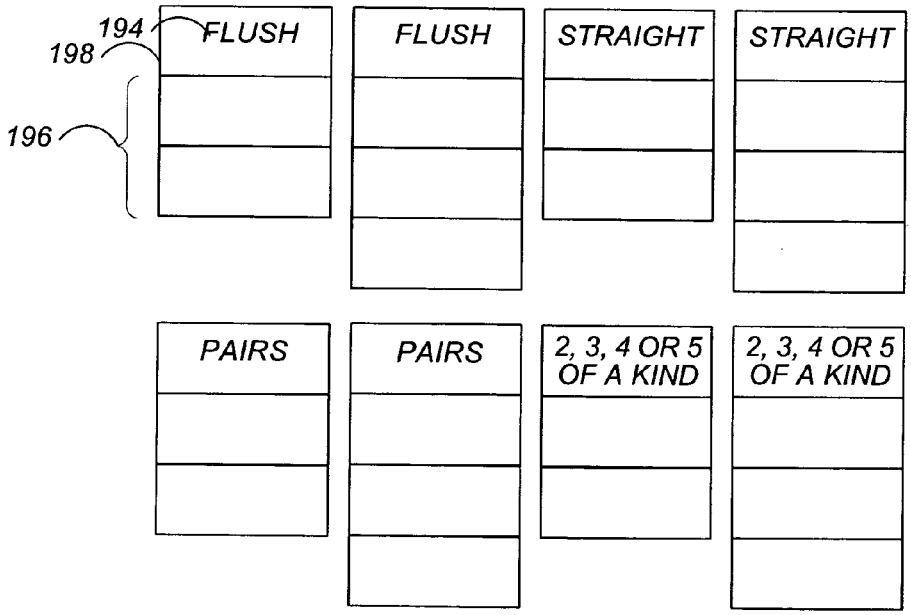
FIG. 12 shows one implementation of streak combinations based on ROG results for a game of poker.
Figure 13:
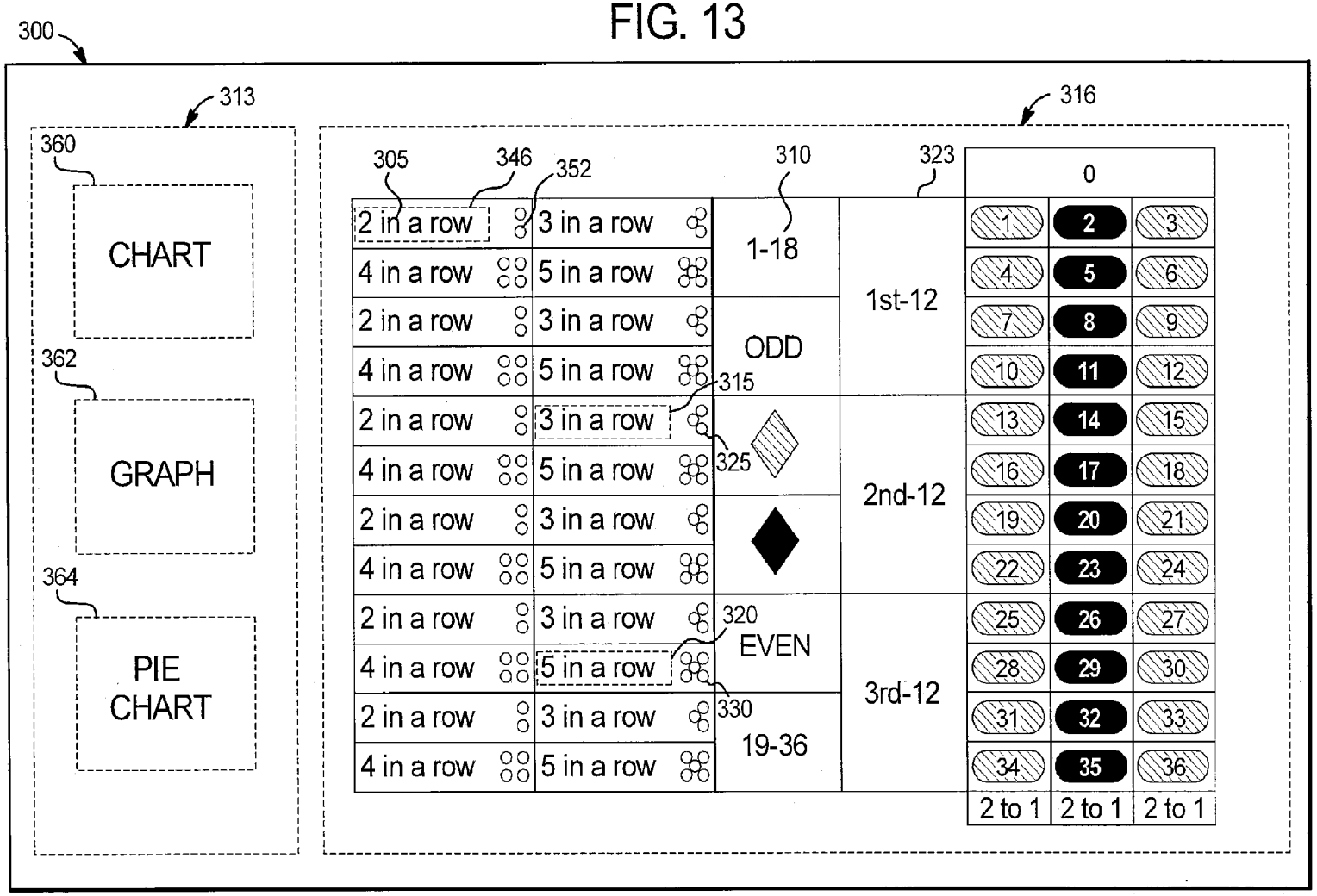
FIG. 13 is a schematic illustration of a display which displays representations adjacent to a game area.

As shown in FIG. 12, a streak combination can be placed on outcomes of a main round of poker. The combinations 198 can indicate the selected outcome 194 and the number of main rounds 196, where the number of main rounds 196 of the streak round are shown by the number of positions into which the stake can be moved.

The invention can be implemented in digital electronic circuitry, or in computer hardware, firmware, software, or in combinations of them. The invention can be implemented as a computer program product, i.e., a computer program tangibly embodied in an information carrier, e.g., in a machine-readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps of the invention can be performed by one or more programmable processors executing a computer program to perform functions of the invention by operating on input data and generating output. Method steps can also be performed by, and apparatus of the invention can be implemented as, special purpose logic circuitry, e.g., an FPGA (field programmable gate array) or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

A number of implementations of the invention have been described. Nevertheless, it will be understood that various modifications may be made without departing from the spirit and scope of the invention. For example, a tie, such as in blackjack may neither end the streak wager nor advance the progress along the streak wager. The house can determine rules to deal with particular situations such as a tie. The streak wager area can be horizontally or vertically oriented, and two- or three-dimensional. Implementations that have been described above in an electronic form can be implemented in a physical form, such as a table, a wheel, a pit or as cards. Similarly, implementations that have been described above in a physical form can also be implemented in an electronic form. In some implementations of the streak game, different streak combinations can be selected to occur consecutively to make up a streak round. An example of multiple different streak combinations making up a single streak round where the main game is poker includes a first streak combination of two hands with a pair occurring in a row and a second streak combination of three consecutive rounds of poker where the outcome is three of a kind. The streak round is won when the two streak combinations are achieved consecutively. Although a streak round is generally described as being based on a main round, a streak round can be based only on ROG results that do not correspond to a main round. For example, the ROG results can stand on their own or multiple ROG results may be needed for a main round and each ROG result is used to determine a portion of the streak round. Accordingly, other embodiments are within the scope of the following claims.

What is claimed is:

1. A method of operating a gaming system including a plurality of instructions, said method comprising:

(a) causing at least one display device to display a streak game;

(b) causing the at least one display device to display a first streak area associated with the streak game, the first streak area having a first quantity of advancement levels associated with a first streak condition;

(c) causing the at least one display device to indicate a first opportunity for a player to place a plurality of first streak wagers associated with the first streak condition;

(d) causing the at least one display device to display a second streak area associated with the streak game, the second streak area having a second quantity of advancement levels associated with a second, different streak condition;

(e) causing the at least one display device to indicate a second opportunity for said player to place a plurality of second streak wagers associated with the second, different, streak condition;

(f) receiving an input from said player corresponding to at least one of the first streak wagers and the second streak wagers;

(g) causing at least one processor to execute the plurality of instructions to start the streak game for said player after the input is received;

(h) causing the at least one display device to display a plurality of consecutive rounds of the streak game for said player;

(i) causing the at least one processor to execute the plurality of instructions to simultaneously track whether the first and second streak conditions are satisfied for said player, (w) for a first one of the first streak wagers, the tracking including:

(1) causing the at least one display device to display a first symbol associated with the first streak wager at a first one of the advancement levels of the first streak area in response to a first one of the consecutive rounds resulting in a first outcome which satisfies the first streak condition, and (2) causing the at least one display device to display the first symbol associated with the first streak wager at a second one of the advancement levels of the first streak area in response to a second one of the consecutive rounds resulting in the first outcome which satisfies the first streak condition, and (x) for a first one of the second streak wagers, the tracking including:

(1) causing the at least one display device to display a second symbol associated with the second streak wager at a first one of the advancement levels of the second streak area in response to the first one of the consecutive rounds resulting in a second outcome which satisfies the second, different streak condition, and (2) causing the at least one display device to display the second symbol associated with the second streak wager at a second one of the advancement levels of the second streak area in response to the second one of the consecutive rounds resulting in the second outcome which satisfies the second, different streak condition, and (y) for a second one of the first streak wagers, the tracking including:

(1) while displaying the first symbol at the second one of the advancement levels of the first streak area, causing the at least one display device to display a third symbol associated with the second one of the first streak wagers at the first one of the advancement levels of the first streak area in response to the first one of the consecutive rounds resulting in the first outcome which satisfies the first streak condition, and (z) for a second one of the second streak wagers, the tracking including:

(1) while displaying the second symbol at the second one of the advancement levels of the second streak area, causing the at least one display device to display a fourth symbol associated with the second one of the second streak wagers at the first one of the advancement levels of the second streak area in response to the first one of the consecutive rounds resulting in the second outcome which satisfies the second, different streak condition;

(j) for each one of the first streak wagers received from said player, providing a first award in response to a first quantity of the consecutive rounds resulting in a plurality of identical first outcomes which satisfy the first streak condition, the first award being based on the received first streak wager; and (k) for each one of the second streak wagers received from said player, providing a second award in response to a second quantity of the consecutive rounds resulting in a plurality of identical second outcomes which satisfy the second streak condition, the second award being based on the received second streak wager.

2. The method of claim 1, further comprising:

providing a difference between the first and second streak conditions, wherein the difference includes a different quantity of outcomes.

3. The method of claim 1, which includes causing the at least one display device to display a primary game in association with the displayed streak game, wherein:

receiving one of the first and second streak wagers does not include receiving a wager for the primary game.

4. The method of claim 1, which includes:

causing the at least one display device to display a representation of at least one of the first and second streak wagers, the displayed representation indicating a point value.

5. The method of claim 1, which includes:

causing the at least one display device to display a representation of at least one of the first and second streak wagers, the displayed representation indicating a monetary value.

6. The method of claim 1, wherein:

causing the at least one display device to indicate a third opportunity for said player to place a third streak wager associated with a third streak condition.

7. The method of claim 6, which includes:

causing the at least one display device to indicate the third opportunity for said player to place the third streak wager before at least one of the first and second streak wagers is resolved, wherein:

(a) the first streak wager is resolved when one of a first plurality of outcomes occurs after the received input corresponds to the first streak wager, the outcomes including: (i) a non-selected outcome other than the first outcome occurs, or (ii) the first outcome occurs in each of the displayed plurality of consecutive rounds; and (b) the second streak wager is resolved when one of a second plurality of outcomes occurs after the received input corresponds to the second streak wager, the outcomes including: (i) a non-selected outcome other than the second outcome, and (ii) the second outcome in each of the displayed plurality of consecutive rounds.

8. The method of claim 6, which includes:

causing the at least one display device to indicate the second opportunity to place the second streak wager after the received input corresponds to the first streak wager and before the first streak wager is resolved.

9. The method of claim 6, wherein:

the third streak condition requires a third outcome in each of the consecutive rounds.

10. The method of claim 1, further comprising:

providing a difference between the first and second streak conditions, wherein the difference includes at least one different type of outcome.

11. The method of claim 1, wherein:

the first streak wager is associated with a first quantity of the plurality of consecutive rounds and the second streak wager is associated with a second quantity of the plurality of consecutive rounds.

12. The method of claim 11, which includes:

causing the at least one display device to indicate each consecutive occurrence of the first outcome in the first quantity of consecutive rounds with a first indicator;

causing the at least one processor to execute the plurality of instructions to move the first indicator to track the satisfaction of the first streak wager;

causing the at least one display device to indicate each consecutive occurrence of the second outcome in the second quantity of consecutive rounds with a second indicator; and causing the at least one processor to execute the plurality of instructions to move the second indicator to track the satisfaction of the second streak wager.

13. The method of claim 11, which includes:

causing the at least one display device to indicate each consecutive occurrence of the first outcome in the first quantity of consecutive rounds with a first indicator;

causing the at least one processor to execute the plurality of instructions to change the first indicator to track the satisfaction of the first streak wager;

causing the at least one display device to indicate each consecutive occurrence of the second outcome in the second quantity of consecutive rounds with a second indicator; and causing the at least one processor to execute the plurality of instructions to change the second indicator to track the satisfaction of the second streak wager.

14. The method of claim 11, which includes:

causing the at least one display device to display a graph to indicate a ratio of the consecutive rounds for which the first outcome occurred to the first quantity of consecutive rounds; and causing the at least one processor to execute the plurality of instructions to change the graph to indicate a different ratio when a number of the consecutive rounds for which the first outcome occurred increases.

15. The method of claim 11, which includes:

causing the at least one processor to execute the plurality of instructions to determine the first award for the player based on the first quantity of consecutive rounds; and causing the at least one processor to execute the plurality of instructions to determine the second award for the player based on the second quantity of consecutive rounds.

16. The method of claim 15, which includes:

causing the at least one processor to execute the plurality of instructions to determine the first award based on a first multiplier associated with the first quantity of consecutive rounds; and causing the at least one processor to execute the plurality of instructions to determine the second award based on a second multiplier associated with the second quantity of consecutive rounds.

17. The method of claim 1, which includes:

receiving an input from said player independent of any input received from any other player of the streak game.

18. A method of operating a gaming system including a plurality of instructions, said method comprising:

(a) providing a first player with an opportunity to play a base game;

(b) receiving at least one game wager from the first player for a play of the base game;

(c) receiving a plurality of side wagers from the first player for a play of a streak game, the plurality of side wagers including:

(i) a first one of the side wagers associated with a first streak condition, the first streak condition requiring a plurality of identical first outcomes, and (ii) a second one of the side wagers associated with a different, second streak condition, the second streak condition requiring a plurality of identical second outcomes;

(d) causing at least one processor to execute the plurality of instructions to start the base game after at least one of the plurality of side wagers is received from the first player;

(e) enabling a plurality of consecutive plays of the base game by the first player;

(f) causing at least one display device to display a first play of the base game for the first player, the first play being one of the plurality of consecutive plays of the base game;

(g) causing the at least one processor to execute the plurality of instructions to track whether one of the plurality of first outcomes occurs for the first play of the base game;

(h) in response to one of the plurality of first outcomes occurring for the first play of the base game, providing the first player with an opportunity to place another one of the side wagers associated with the first streak condition while the first one of the side wagers associated with the first streak condition is active;

(i) causing the at least one display device to display a second play of the base game for the first player, the second play being one of the plurality of consecutive plays of the base game;

(j) causing the at least one processor to execute the plurality of instructions to simultaneously track a satisfaction of the first and second streak conditions for the first player;

(k) providing a first award in response to the consecutive plays resulting in a satisfaction of the first streak condition, the first award being based on the first side wager; and (l) providing a second award in response to the consecutive plays resulting in a satisfaction of the second streak condition, the second award being based on the second side wager.

19. The method of claim 18, wherein:

the first streak wager is received before starting the base game and the second streak wager is received after starting the base game.

20. The method of claim 19, wherein:

the satisfaction of the first streak condition and the satisfaction of the second streak condition are based on the plurality of consecutive plays of the base game, the first and second streak conditions being satisfiable concurrently in the consecutive plays of the base game.

21. The method of claim 18, including:

providing a difference between the first and second streak conditions, the difference including a different quantity of outcomes.

22. The method of claim 18, which includes providing a difference between the first and second streak conditions, the difference including at least one different type of outcome.

23. An apparatus comprising:

at least one display device configured to display an image associated with a game, the game being operable upon:

(a) at least one game wager receivable from a player, and (b) a plurality of side wagers which are receivable from the player;

at least one memory device which stores a plurality of instructions; and at least one processor configured to execute the instructions to:

(a) cause the at least one game wager to be received from the player, (b) cause a plurality of the side wagers to be received from the player, the plurality of side wagers being received independent of any side wager received from any other player in the game, the plurality of side wagers including:

(i) a first one of the side wagers associated with a first streak condition, the first streak condition requiring a plurality of identical first outcomes, and (ii) a second one of the side wagers associated with a different, second streak condition, the second streak condition requiring a plurality of identical second outcomes, (c) start the game after the plurality of side wagers are received from the player, (d) enable a plurality of consecutive plays of the game by the player, (f) cause a display of a first play of the base game for the player, the first play being one of the plurality of consecutive plays of the base game;

(g) track whether one of the plurality of first outcomes occurs for the first play of the base game;

(h) in response to one of the plurality of first outcomes occurring for the first play of the base game, provide the first player with an opportunity to place another one of the side wagers associated with the first streak condition while the first one of the side wagers associated with the first streak condition is active;

(i) display a second play of the base game for the first player, the second play being one of the plurality of consecutive plays of the base game;

(j) simultaneously track a satisfaction of the first and second streak conditions for the player, (k) provide a first award in response to the consecutive plays resulting in a satisfaction of the first streak condition, the first award being based on the first side wager, and (l) provide a second award in response to the consecutive plays resulting in a satisfaction of the second streak condition, the second award being based on the second side wager.

24. The apparatus of claim 23, which includes:

at least one instruction, which when executed by the at least one processor, causes the at least one processor to display a representation indicating any occurrences of: (a) the identical first outcomes during the consecutive plays of the game; and (b) the identical second outcomes during the consecutive plays of the game.

25. The apparatus of claim 24, which includes:

at least one instruction, which when executed by the at least one processor, causes the at least one processor to display:

(a) a first indicator which is movable along a first path to track a quantity of the occurrences of the first outcome during the consecutive plays of the game, and (b) a second indicator which is movable along a second path to track a quantity of the occurrences of the second outcome during the consecutive plays of the game.

26. The apparatus of claim 25, which includes:

at least one instruction, which when executed by the at least one processor, causes the at least one processor to display the first and second paths simultaneously for the player.

27. The apparatus of claim 25, wherein:

the first and second indicators are associated with the player.

28. The apparatus of claim 25, wherein:

the first path includes a first number of positions which are sequentially indicatable by the first indicator, the first number of positions being associated with the first award; and the second path includes a second number of positions which are sequentially indicatable by the second indicator, the second number of positions being associated with the second award.

29. The apparatus of claim 28, wherein:

the first number of positions are linearly aligned or aligned along an arc.

30. The apparatus of claim 28 wherein:

the second number of positions are linearly aligned or aligned along an arc.

31. The apparatus of claim 28 which includes:

at least one instruction, which when executed by the at least one processor, causes the at least one processor to:

(a) display the first path such that each one of the first number of positions is a part of a first image; and (b) display the second path such that each one of the second number of positions is a part of a second image.

32. The apparatus of claim 24 which includes:

at least one instruction, which when executed by the at least one processor, causes the at least one processor to display the representation as at least one graph or chart.

33. The apparatus of claim 32 wherein:

the representation includes a bar graph.

34. The apparatus of claim 32 wherein:

the representation includes a pie chart.

35. The apparatus of claim 23, which includes a difference between the first and second streak conditions, the difference including a different quantity of outcomes.

36. The apparatus of claim 23, what includes a difference between the first and second streak conditions, the difference including at least one different type of outcome.

37. An apparatus comprising:

at least one display device;

at least one memory device which stores a plurality of instructions; and at least one processor configured to execute the instructions to control the display device to:

(a) display a game image associated with a game operable upon at least one wager, the game image including a first streak area having a first quantity of advancement levels and a second streak area having a second quantity of advancement levels, (b) for a player of the game:

indicate an opportunity for the player to place a plurality of first streak wagers associated with the first streak area, (ii) indicate an opportunity for the player to place a plurality of second streak wagers associated with the second streak area, (iii) simultaneously track any occurrences of:

(x) any first streak outcomes achieved by the player during a plurality of consecutive plays of the game resulting from the first streak wagers placed by said player, and (y) any second streak outcomes achieved by the player during a plurality of consecutive plays of the game resulting from the second streak wagers placed by said player, and (iv) display at least one additional image which indicates:

(w) a first occurrence of one of the first streak outcomes achieved by said player during a plurality of consecutive plays of the game at a first one of the advancement levels of the first streak area associated with a first one of the first streak wagers, (x) a second occurrence of one of the first streak outcomes achieved by said player during the plurality of consecutive plays of the game at a second one of the advancement levels of the first streak area associated with a second one of the first streak wagers, (y) a first occurrence of one of the second streak outcomes achieved by said player during the plurality of consecutive plays of the game at a first one of the advancement levels of the second streak area associated with a first one of the second streak wagers, and (z) a second occurrence of one of the second streak outcomes achieved by said player during the plurality of consecutive plays of the game at a second one of the advancement levels of the second streak area associated with a second one of the first streak wagers.

38. A computer program storage device for providing a streak game, the computer program storage device comprising:

a data storage medium storing a plurality of instructions, which when executed by at least one processor, cause a computer system to:

(a) receive a first streak wager on a first streak round from a player of the streak game;

(b) receive a second streak wager on a second streak round from said player;

(c) display a representation of the first and second streak wagers, wherein:

(i) the first streak wager is associated with:

(x) the first streak round having a first plurality of advancement levels associated with a selected first number of consecutive main rounds; and (y) a selected type of outcome for each main round; and (ii) the second streak wager is associated with:

(x) the second streak round having a second plurality of advancement levels associated with a selected second number of consecutive main rounds; and (y) a selected type of outcome for each main round;

(d) start the streak game after the first and second streak wagers are received from the player;

(e) receive an outcome of a current main round;

(f) determine whether the received outcome is identical to the selected type of outcome for each main round for the first streak round;

(g) for each main round for the first streak round, if the received outcome is identical to the selected type of outcome for the main round, display a representation of the first streak wager moving to a different one of the advancement levels, (h) determine whether the received outcome is identical to the selected type of outcome for each main round for the second streak round;

(i) for each main round for the second streak round, if the received outcome is identical to the selected type of outcome for the main round, display a representation of the second streak wager moving to a different one of the advancement levels, (j) repeat steps (e) through (i) at least once;

(k) provide an opportunity for the player to place an additional streak wager on the first streak round;

(l) for the first streak wager and the additional streak wager, separately track how many of the received consecutive outcomes are identical to the selected type of outcomes for each main round for the first streak round; and (m) for the second streak wager, track how many of the received consecutive outcomes are identical to the selected type of outcome for each main round for the second streak round, where the first streak round is tracked separately from the second streak round.

39. The computer program storage device of claim 38, wherein there is a difference selected from the group consisting of: (a) a difference between the selected first number and the selected second number; and (b) a difference between the selected type of outcome.

40. The computer program storage device of claim 38 further comprising instructions to cause the computer system to:

indicate an end to the first or second streak round, including paying the player independent of any other player of the streak game.

41. The computer program storage device of claim 38 wherein the instructions to receive the first streak wager do not include instructions to cause the computer system to receive a wager for the main round.

42. The computer program storage device of claim 38 wherein the instructions to display a representation of the first and second streak wagers include instructions executable to cause the computer system to:

indicate a point value of the wagers.

43. The computer program storage device of claim 38 wherein the instructions to display a representation of the first and second streak wagers include instructions executable to cause the computer system to:

indicate a monetary value of the wagers.

44. The computer program storage device of claim 38 further comprising instructions executable to cause the computer system to:

receive a third streak wager on a third streak round from said player and display a representation of the third streak wager, wherein the third streak wager is associated with the third streak round having a selected third number of consecutive main rounds and a selected type of outcome for each main round.

45. The computer program storage device of claim 44 wherein:

the third streak wager is received before the first or second streak rounds have ended, wherein the first or second streak rounds have ended when either, after the first or second streak wager has been made, a non-selected outcome occurs or the first or second number of consecutive main rounds equals the number of consecutive main rounds that have ended with a corresponding selected outcome.

46. The computer program storage device of claim 45 wherein:

the third selected number is equal to the first selected number.

47. The computer program storage device of claim 38 wherein:

more than one streak round is associated with a single main round.

48. The computer program storage device of claim 38 further comprising instructions executable to cause the computer system to:

determine a payout for the player based on the first or second selected number of consecutive main rounds.

49. The computer program storage device of claim 48 wherein:

the payout is determined based on a multiplier associated with the first or second selected number of consecutive main rounds.

50. The computer program storage device of claim 38 wherein the instructions to track how many of the received outcomes are identical to the selected outcomes for the first and second streak rounds includes instructions executable to cause the computer system to conduct said tracking simultaneously for the first and second streak rounds.

51. The computer program storage device of claim 38 wherein the instructions to track how many of the received outcomes are identical to the selected outcomes for the first and second streak rounds includes instructions executable to cause the computer system to:

change an element of the representation.

52. The computer program storage device of claim 38, wherein the instructions to track the number of received outcomes that are identical to the selected outcomes for the first and second streak rounds includes instructions executable to cause the computer system to:

display a graph that indicates a ratio of the main rounds having had an outcome that is identical to the selected outcome for the first streak round to the selected number of main rounds that make up the first streak round; and update the graph to show a new ratio.

53. The computer program storage device of claim 38, wherein the instructions to display the representation includes instructions executable to cause the computer system to:

display the representation electronically.

54. A computer program storage device for providing a streak round, the computer program device comprising:

a data storage medium storing a plurality of instructions, which when executed by at least one processor, cause a computer system to:

(a) receive a first streak wager associated with a first streak round from a player;

(b) display a representation of the first streak wager at a first position on a first path;

(c) receive a second streak wager associated with a second streak round from said player;

(d) display a representation of the second streak wager at a first position on a second path;

(e) generate an outcome of a main round;

(f) determine whether the generated outcome satisfies a first streak condition associated with the first streak round;

(g) determine whether the generated outcome satisfies a different, second streak condition associated with the second streak round;

(h) display the representation of the first streak wager at another position on the first path in response to the generated outcome satisfying the first streak condition associated with the first streak round;

display the representation of the second streak wager at another position on the second path in response to the generated outcome satisfying the second streak condition associated with the second streak round; and (j) provide said player an opportunity to place an additional streak wager associated with the first streak round;

(x) in response to the additional streak wager being received:

(1) while the representation of the first streak wager is displayed at another position on the first path, display a representation of the third streak wager at the first position on the first path;

(2) display the representation of the third streak wager at another position on the first path in response to the generated outcome satisfying the first streak condition associated with the first streak round;

(k) repeat (e) to (j) until an ending condition is satisfied.

55. The computer program storage device of claim 54, further comprising instructions to cause a computer system to:

receive the first streak wager before the outcome of the main round is generated and receive the second streak wager after the outcome of the main round is generated.

56. The computer program storage device of claim 54, wherein:

the first streak wager is associated with:

(x) the first streak round having a selected first number of consecutive main rounds; and (y) a selected type of outcome for each main round; and the second streak wager is associated with:

(x) the second streak round having a selected number of consecutive main rounds; and (y) a selected type of outcome for each main round.

57. The computer program storage device of claim 56, wherein:

the selected type of outcome for each main round of the first streak round is identical to the selected type of outcome for each main round of the second streak round.

58. The computer program storage device of claim 54, wherein:

the first streak condition is satisfiable upon the generated outcome being identical to the selected type of outcome for each main round of the first streak round; and the second streak condition is satisfiable upon the generated outcome being identical to the selected type of outcome for each main round of the second streak round.

59. The computer program storage device of claim 54, wherein there is a difference between the first and second streak conditions, the difference being selected from the group consisting of: (a) a different quantity of outcomes; and (b) at least one different type of outcome.

* * * * *

UNITED STATES PATENT AND TRADEMARK OFFICE

CERTIFICATE OF CORRECTION

PATENT NO. : 7,867,080 B2
APPLICATION NO. : 10/668670
DATED : January 11, 2011
INVENTOR(S) : Nicely et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1001 days.

Signed and Sealed this
Thirteenth Day of September, 2011

David J. Kappos

David J. Kappos
*Director of the United States Patent and Trademark Office*